US009383686B2

(12) United States Patent
Murakami

(10) Patent No.: US 9,383,686 B2
(45) Date of Patent: Jul. 5, 2016

(54) DEVELOPER SUPPLY CONTAINER AND IMAGE FORMING APPARATUS

(71) Applicant: CANON KABUSHIKI KAISHA, Tokyo (JP)

(72) Inventor: Katsuya Murakami, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/926,433

(22) Filed: Oct. 29, 2015

(65) Prior Publication Data

US 2016/0131997 A1 May 12, 2016

(30) Foreign Application Priority Data

Nov. 10, 2014 (JP) ..... 2014-228137

(51) Int. Cl.
*G03G 15/08* (2006.01)
*G03G 15/095* (2006.01)

(52) U.S. Cl.
CPC ..... *G03G 15/095* (2013.01)

(58) Field of Classification Search
CPC ..... G03G 15/095
See application file for complete search history.

(56) References Cited

U.S. PATENT DOCUMENTS

| | | | | |
|---|---|---|---|---|
| 6,049,685 | A | 4/2000 | Murakami et al. | |
| 6,128,453 | A | 10/2000 | Ban et al. | |
| 6,278,853 | B1 | 8/2001 | Ban et al. | |
| RE38,737 | E | 5/2005 | Ban et al. | |
| 7,242,893 | B2 | 7/2007 | Murakami et al. | |
| 7,738,818 | B2 | 6/2010 | Murakami et al. | |
| 7,822,372 | B2 * | 10/2010 | Nagashima | G03G 21/1676 399/258 |
| 8,000,614 | B2 | 8/2011 | Okino et al. | |
| 2007/0280743 | A1 | 12/2007 | Nakajima et al. | |
| 2012/0200871 | A1 * | 8/2012 | Takahashi | G03G 21/1652 358/1.9 |

FOREIGN PATENT DOCUMENTS

| | | | |
|---|---|---|---|
| JP | 60006968 | A * | 1/1985 |
| JP | H06-186847 | A | 7/1994 |
| JP | 2006-178438 | A | 7/2006 |

* cited by examiner

*Primary Examiner* — G. M. Hyder
(74) *Attorney, Agent, or Firm* — Fitzpatrick, Cella, Harper & Scinto

(57) ABSTRACT

A developer supplying container includes a rotatable developer discharging portion, a drive transmitting portion, a suppressing portion movable between an operating position and a non-operating position; and a recessed portion, provided on an outer peripheral surface of the developer supply container, for reducing a sliding load between an outer peripheral surface of the developer supply container and a wiping member of a developer receiving apparatus when the developer supply container is rotated in a circumferential direction.

3 Claims, 15 Drawing Sheets

(a)

(b)

(a)

(b)

(a)

(b)

(a)

(b)

(a)

(b)

(c)

DEVELOPER SUPPLY CONTAINER AND IMAGE FORMING APPARATUS

FIELD OF THE INVENTION AND RELATED ART

The present invention relates to a developer supply container for supplying a developer, and an image forming apparatus to which the developer supply container is detachably mountable to the image forming apparatus.

Conventionally, a developer (toner) in the form of fine powder is used for image formation in the image forming apparatus such as a copying machine and/or printer of an electrophotographic type. In such an image forming apparatus, the developer is supplied from a developer supply container exchangeably set in the image forming apparatus with consumption of the developer.

The developer comprises extremely fine particles. For this reason, there is a liability that developer scatters depending on the handling upon developer supply operation. Therefore, a type has been put into practice wherein the developer supply container is installed in a main assembly of the image forming apparatus, and the developer is discharged gradually through a small opening.

For example, a developer supply container using a cylindrical container including a feeding member for stirring and feeding the developer therein has been proposed (Japanese Laid-Open Patent Application (JP-A) 2006-178438 and JP-A Hei 06-186847). After such a developer supply container is inserted and mounted into the main assembly of the image forming apparatus, a user rotates the developer supply container in a circumferential direction through a predetermined angle. As a result, the developer supplying operation of the developer supply container becomes possible. More particularly, by the rotation of the developer supply container in the circumferential direction, an opening provided in an outer peripheral surface of the developer supply container is brought into communication with an opening provided in the image forming apparatus main assembly side, thus enabling the supply of the developer.

With respect to the developer supply container disclosed in JP-A 2006-178438, it is possible to automatically perform a rotating operation of the developer supply container in the circumferential direction. Specifically, a drive (driving force) receiving member for driving a stirring member engages with a driving member of the image forming apparatus to receive a driving force, so that first the developer supply container rotates in the circumferential direction to be placed in a developer supplyable state, and then the stirring member rotates to discharge the developer. Such a constitution is employed.

In the image forming apparatus disclosed in JP-A Hei 06-186847, an elastic wiping member at an accommodating portion for accommodating the developer supply container is provided. This wiping member is provided in contact with an outer peripheral surface of the developer supply container and is constituted so that when the developer supply container is demounted from and mounted in the accommodating portion, the developer deposited on the outer peripheral surface of the developer supply container is removed.

For example, it is assumed that in order to wipe off the developer deposited on the outer peripheral surface of the developer supply container of JP-A 2006-178438, the wiping member is provided at the accommodating portion of the developer supply container as in the image forming apparatus of JP-A Hei 06-186847. In that case, there is a liability that a rotational resistance of the developer supply container during automatic rotation is increased by contact between the wiping member and the developer supply container and thus improper rotation generates.

SUMMARY OF THE INVENTION

A principal object of the present invention is to provide a developer supply container capable of not only removing a developer deposited on an outer peripheral surface thereof with reliability but also performing automatic rotation thereof with reliability.

According to an aspect of the present invention, there is provided a developer supplying container detachably mountable to a developer receiving apparatus including driving means and a wiping member for removing a developer deposited on an outer peripheral surface of the developer supply container by sliding with the outer peripheral surface of the developer supply container, wherein the developer supply container is set by a setting operation with rotation thereof at least in a circumferential direction, the developer supply container comprising: rotatable discharging means for discharging the developer from the developer supply container to an outside of the developer supply container; drive transmitting means for transmitting a driving force of the driving means to the discharging means; suppressing means movable between an operating position where rotation of the drive transmitting means relative to the developer supply container is suppressed to rotate the developer supply container in the circumferential direction by the driving force received from the driving means and a non-operating position; and a recessed portion, provided on an outer peripheral surface of the developer supply container, for reducing a sliding load between the outer peripheral surface of the developer supply container and the wiping member when the developer supply container is rotated in the circumferential direction.

These and other objects, features and advantages of the present invention will become more apparent upon a consideration of the following description of the preferred embodiments of the present invention taken in conjunction with the accompanying drawings.

DESCRIPTION OF THE EMBODIMENTS

An embodiment of a developer supply container according to the present invention and an image forming apparatus to which the developer supply container is detachably mountable will be specifically described with reference to the drawings. First, a structure of an image forming apparatus 100 including a developer receiving apparatus (device) 10 in which a developer supply container 1 according to the present invention will be described using FIG. 1, and then a structure of the developer supply container 1 according to the present invention will be described.

In this embodiment, a system including the developer receiving apparatus 10 and the developer supply container 1 is referred to as a developer supply system. The developer supply container 1 in this embodiment is provided so as to be detachably mountable to an accommodating portion 10*a* of the developer receiving apparatus 10, and is set by a setting operation with rotation of the developer supply container 1 at least in a circumferential direction.

The developer supply container 1 is mounted in the developer receiving apparatus 10 and supplies a developer. As an example of the developer receiving apparatus 10, it is possible to cite the image forming apparatus 100 such as a copying machine, a facsimile apparatus or a printer, or an image forming unit provided so as to be detachably mountable to the image forming apparatus 100.

(Image Forming Apparatus)

Figure 1:
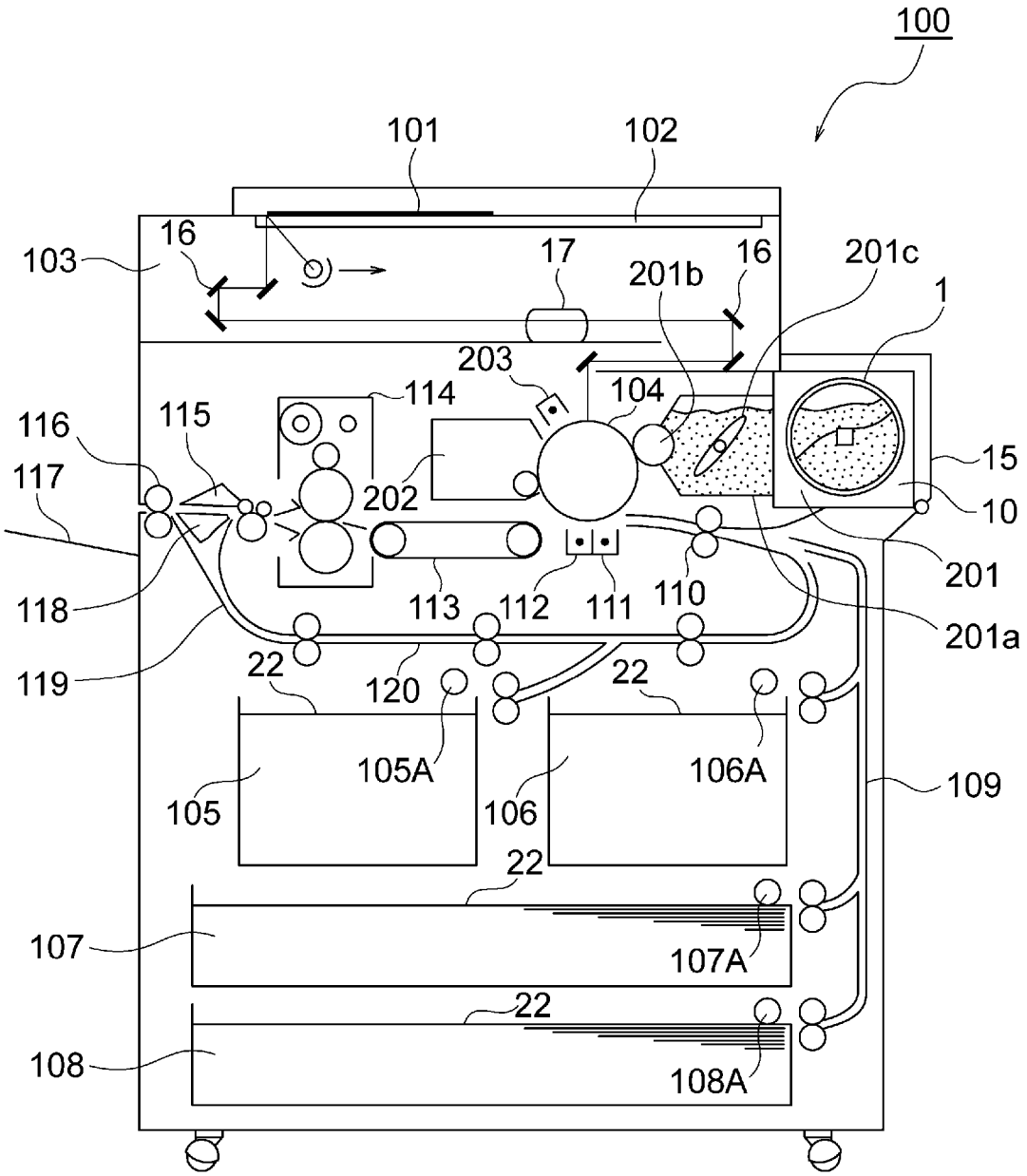
FIG. 1 is a sectional illustration showing a structure of an image forming apparatus in which a developer supply container according to the present invention is mounted.

Referring to FIG. 1, a structure of a copying machine employing an electrophotographic type process, will be described as the example of the image forming apparatus 100 comprising the developer receiving apparatus 10 which can be loaded with the developer supply container 1.

In FIG. 1, designated by 100 is the image forming apparatus consisting of an electrophotographic copying machine. Designated by 101 is an original placed on an original supporting platen glass 102. A light image is formed on a photosensitive drum 104 consisting of an electrophotographic photosensitive member as an image bearing member in accordance with image information through an optical portion 103 including a plurality of mirrors 16 and a lens 17, so that electrostatic latent image is formed. The electrostatic latent image is visualized with a developer (toner) by a developing device 201 which is a developing means.

The developer in this embodiment is a toner. Therefore, a container body 1*a* of the developer supply container 1 accommodates the developer (toner) to be supplied. In the case of a constitution in which development is effected using the developer containing toner particles and carrier particles, the container body 1*a* of the developer supply container 1 may accommodate both of the toner and the carrier and may supply the mixture. In the case of a constitution in which development is effected using the developer containing the toner particles and the carrier particles, the container body 1*a* of the developer supply container 1 may accommodate the carrier and may supply the carrier.

Designated by 105-108 are feeding cassettes accommodating recording materials (sheets) 22. Among the feeding cassettes 105-108, a proper feeding cassette is selected on the basis of a sheet size of the original 101 or information inputted by the user on a liquid crystal operating portion of the image forming apparatus 100. The recording material is not limited to the sheet 22 of paper, but may be at OHT (overhead transparency) sheet which is a transparent sheet or the like used for an OHP (overhead projector).

The sheet 22 separated and fed one by one from each of the feeding cassettes 105-108 by feeding and separating devices 105A-108A, respectively, is fed to a registration roller 110 via a feeding portion 109. Then, the sheet 22 is fed in synchronism with rotation of a photosensitive drum 104 and scanning timing of the optical portion 103 to between the photosensitive drum 104 and a transfer discharger 111 as a transfer means.

Designated by 111, 112 are the transfer discharger and a separation discharger. The image of the developer formed on the surface of the photosensitive drum 104 is transferred onto the sheet 22 by the transfer discharger 111. The separation discharger 112 separates the sheet 22 having the transferred developer image from the surface of the photosensitive drum 104.

Thereafter, the sheet 22 fed by the feeding portion 113 is subjected to heat and pressure in a fixing device 114 as a fixing means, so that the developer image on the sheet 22 is heat-fixed. Then, the sheet 22 is passed through a discharging/reversing portion 115 and is discharged to a discharging tray 117 by a discharging roller 116, in the case of one-sided copy formation.

In the case of superimposed copy, the sheet 22 is fed again to the registration roller 110 through re-feeding portions 119, 120, and then is discharged to the discharging tray 117 through the path similar to the case of the one-sided copy.

In the case of duplex copy, the sheet 22 is partly discharged to an outside of the apparatus by the discharging roller 116 temporarily through a discharging/reversing portion 115. Thereafter, the sheet 22 is fed into the image forming apparatus 100 by controlling the flapper 118 and by reverse rotation of the discharging roller 116, at proper timing when a terminal end of the sheet 22 has passed the flapper 118 but is still nipped by the discharging rollers 116. After it is fed to the registration roller 110 through the re-feeding portions 119, 120, it is discharged to the discharging tray 117 through the path similar to the case of the one-sided copy. Image forming process means such as a developing apparatus 201 as a developing means, a cleaning device 202 as a cleaning means and a primary charger 203 as a primary charging means are provided around the photosensitive drum 104. The cleaning device 202 has a function of removing the developer remaining on the surface of the photosensitive drum 104. The primary charger 203 is to charge uniformly the surface of the photosensitive drum 104 to prepare for desired electrostatic latent image formation on the photosensitive drum 104.

<Developing Apparatus>

Figure 2:
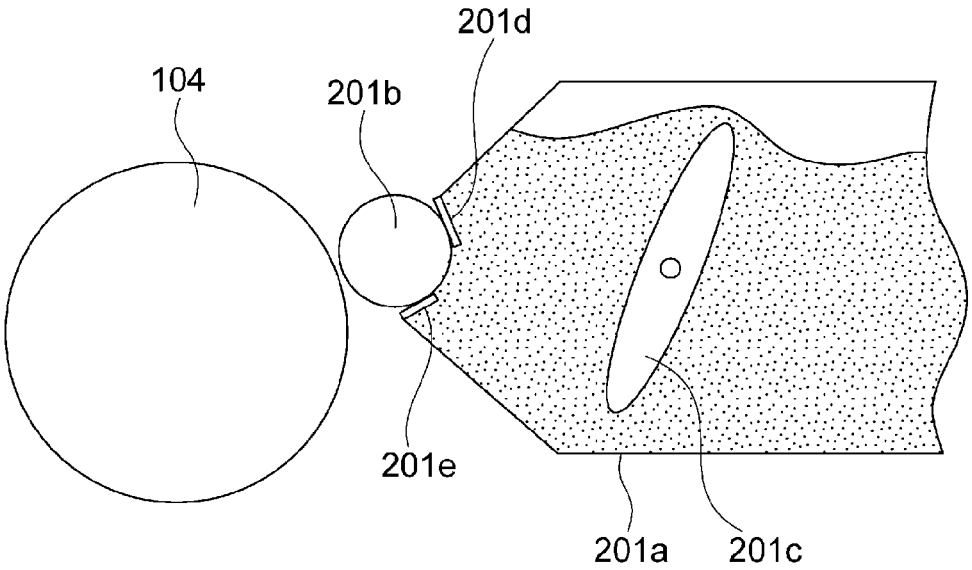
FIG. 2 is a partially sectional view showing a structure of a developing device.

The structure of the developing device 201 will be described using FIGS. 1 and 2. As shown in FIGS. 1 and 2, the developing apparatus 201 develops the electrostatic latent image formed on the surface of the photosensitive drum 104 by the optical portion 103 in accordance with the information of the original, by depositing the developer onto the electrostatic latent image.

The developer supply container 1 for supplying the developer into a developing device 201*a* of the developing apparatus 201 is provided so as to be detachably mountable to a developer receiving apparatus (device) 10 provided in the main assembly of the apparatus 100 by the user.

As shown in FIG. 1, the developing apparatus 201 comprises the developer receiving apparatus 10 for demountably mounting the developer supply container 1, and the developing device 201*a*, and the developing device 201*a* includes a developing roller 201*b* as a developer carrying member and a feeding member 201*c*. The developer supplied from the developer supply container 1 is fed to the developing roller 201*b* by the feeding member 201*c* and then is supplied to the surface of the photosensitive drum 104 by the developing roller 201*b*. The developing roller 201*b* is provided with a developing blade 201*d* for regulating an amount of developer coating on the surface of the developing roller 201*b* and the surface thereof is contacted by a leakage preventing sheet 201*e* to prevent leakage of the developer between itself and the developing device 201*a*.

Figure 10:
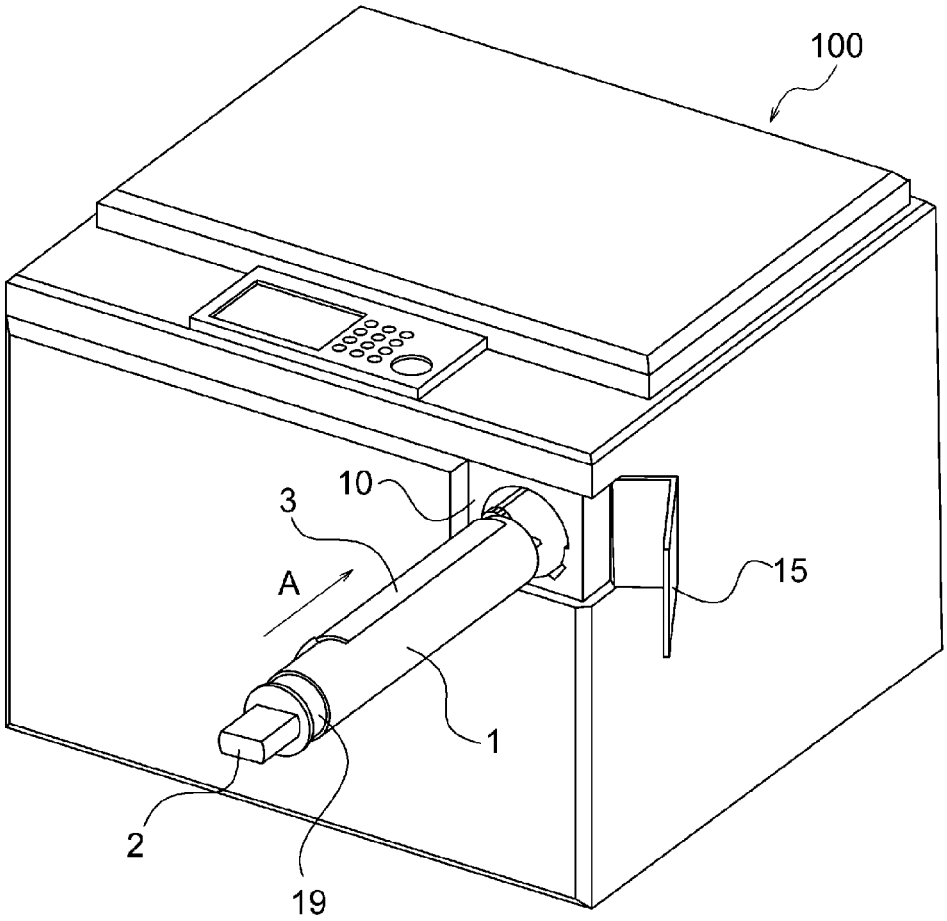
FIG. 10 is a perspective illustration showing a state in which the developer supply container is to be inserted into the developer receiving apparatus provided in an image forming apparatus main assembly.

As shown in FIG. 10, there is provided an openable cover 15 for exchange of the developer supply container 1 at a part of an outer casing of the image forming apparatus 100. When the developer supply container 1 is mounted to or demounted from the developer receiving apparatus 10 provided in the main assembly of the image forming apparatus 100 by the user, the openable cover 15 is opened.

<Developer Receiving Apparatus>

Figure 3:
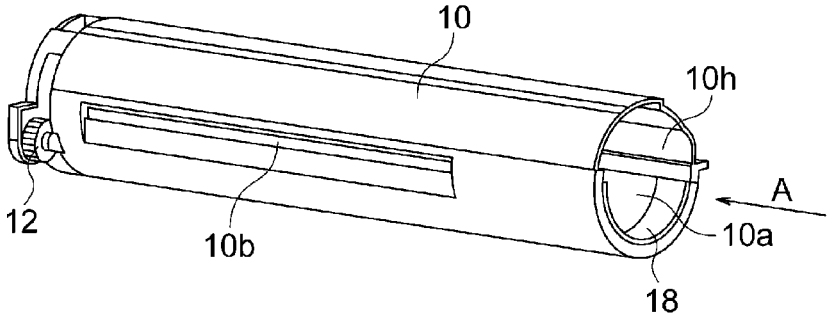
In FIG. 3, (a) and (b) are perspective illustrations each showing a structure of a developer receiving apparatus (device) in which the developer supply container is to be mounted.
Figure 3:
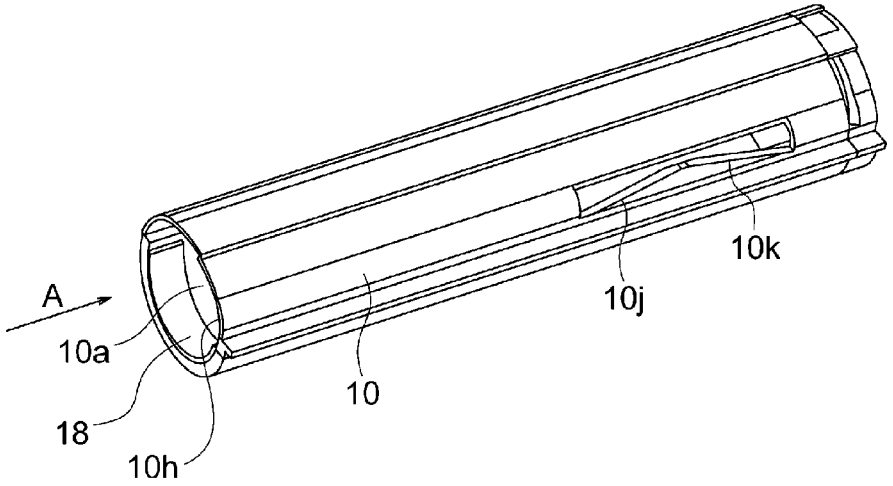
Figure 4:
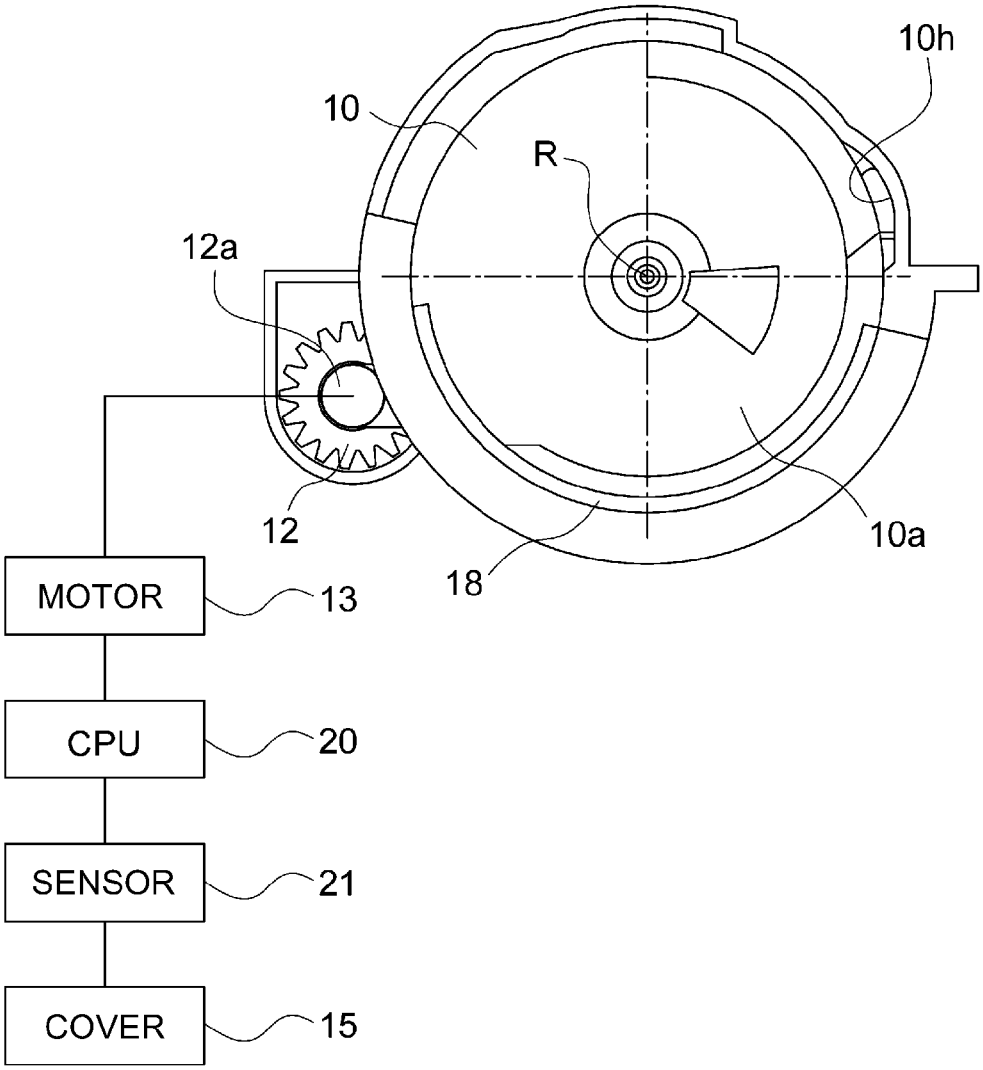
FIG. 4 is a sectional illustration showing the structure of the developer receiving apparatus in which the developer supply container is to be mounted.
Figure 5:
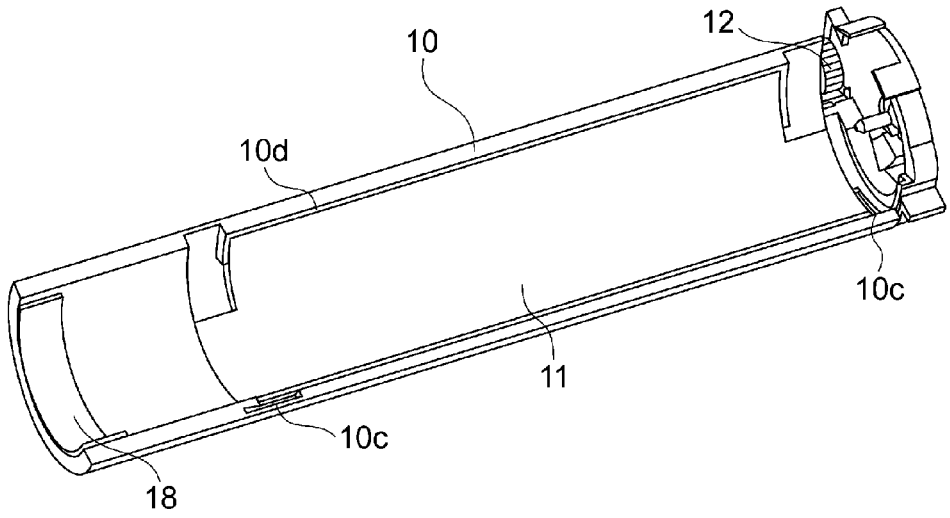
In FIG. 5, (a) is a perspective illustration showing a state of an inside of the developer receiving apparatus of which a developer receiving opening is closed by a shutter, and (b) is a perspective illustration showing a state of an inside of the developer receiving apparatus of which the developer receiving opening is opened by movement of the shutter.
Figure 5:
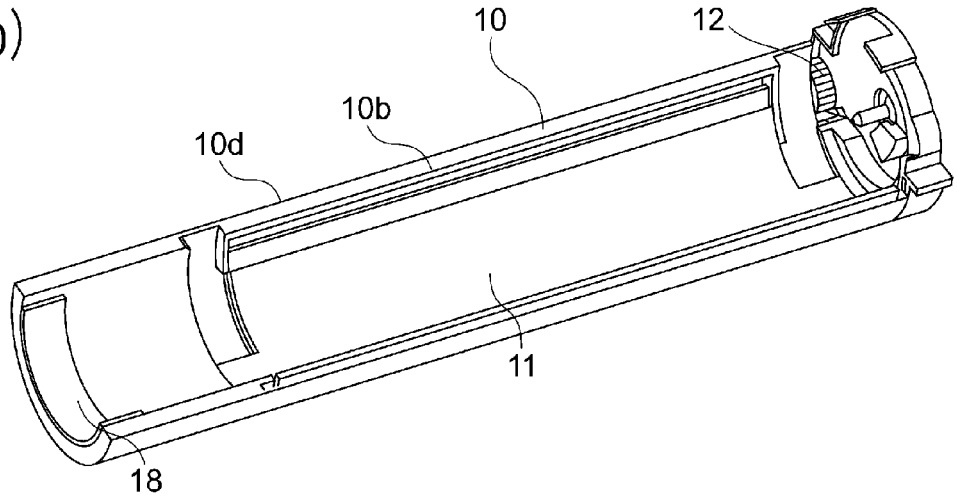

Referring to FIGS. 3 to 5, the developer receiving apparatus 10 comprises an accommodating portion 10*a* for demountably mounting the developer supply container 1, and a developer receiving opening 10*b* for receiving the developer discharged from the developer supply container 1. The developer supplied from the developer receiving opening 10*b* is supplied to the developing device 201*a* and is used for image formation.

As shown in (a) and (b) of FIG. 5, shutter having a substantially semi-cylindrical configuration along an inner peripheral surface configuration of the accommodating portion 10*a* of the developer supply container 1 is provided movably in a circumferential direction. The shutter 11 is engaged with a guide portion 10*c* provided at a lower edge of the accommodating portion 10*a* and is slidably along the circumferential direction to open and close the developer receiving opening 10*b*.

The guide portion 10*c* is formed at each of the opposite edge portions of the developer receiving opening 10*b* which can be unsealed by movement of the shutter 11.

When the developer supply container 1 is not mounted to the accommodating portion 10*a* of the developer receiving apparatus 10, the shutter 11 is at a sealing position sealing the developer receiving opening 10*b* by contacting one end thereof to a stopper portion 10*d* provided in the developer receiving apparatus 10. As a result, the developer is prevented from flowing back from the developing device 201*a* to the accommodating portion 10*a*.

Figure 12:
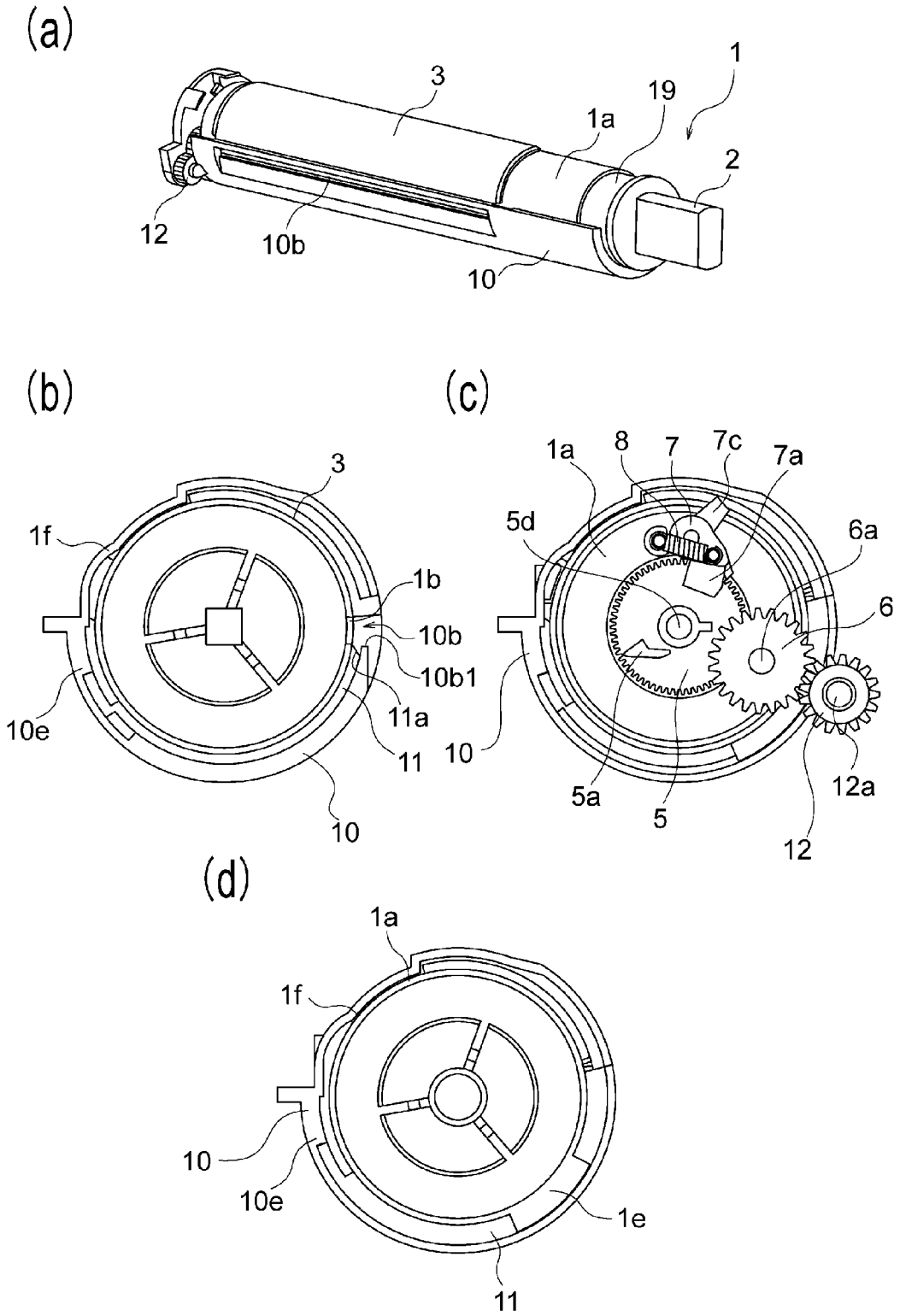
In FIG. 12, (a) is a perspective illustration showing a state the developer supply container is rotated in a circumferential direction after the developer supply container is inserted and mounted in the developer receiving apparatus provided in the image forming apparatus main assembly, and (b), (c) and (d) are side illustrations each showing a state the developer supply container is rotated in the circumferential direction after the developer supply container is inserted and mounted in the developer receiving apparatus provided in the image forming apparatus main assembly.

When the shutter 11 is unsealed (opened), a lower end 10*b*1 of the developer receiving opening 10*b* and an upper end 11*a* of the shutter 11 which are shown in (b) of FIG. 12 are aligned with each other with high accuracy to completely open the developer receiving opening 10*b*. An end position unsealing movement of the shutter 11 is regulated by the stopper portion 10*e* shown in (b) of FIG. 12.

Figure 11:
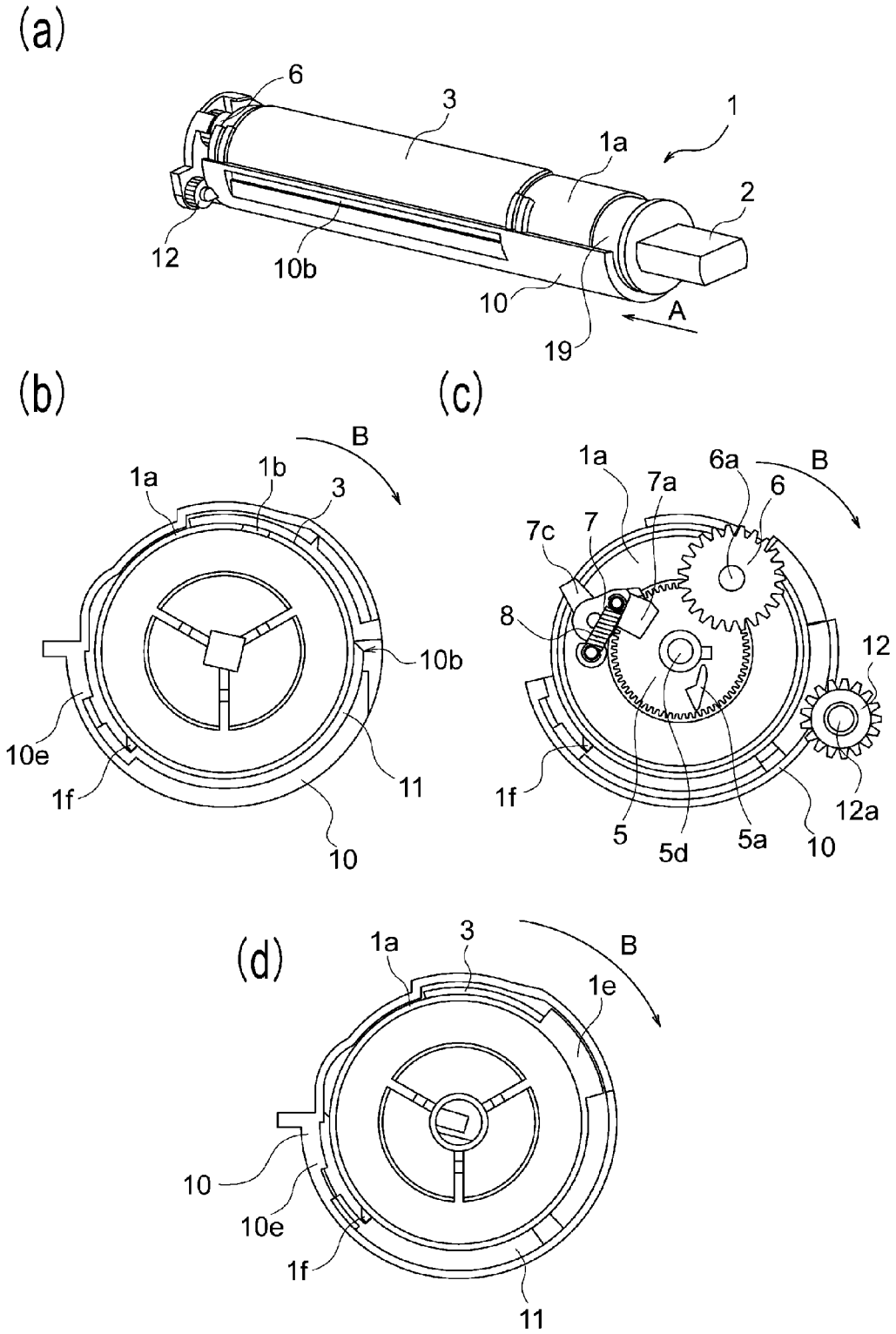
In FIG. 11, (a) is a perspective illustration showing a state after the developer supply container is inserted and mounted in the developer receiving apparatus provided in the image forming apparatus main assembly, and (b), (c) and (d) are side illustrations each showing a state after the developer supply container is inserted and mounted in the developer receiving apparatus provided in the image forming apparatus main assembly.

The stopper 10*e* functions, as shown in (b) of FIG. 12, also as a stop means for stopping rotation of the container body 1*a* at the position where the developer discharge opening 1*b* is opposed to the developer receiving opening 10*b*. Thus, the rotation of the developer supply container 1 engaged with the shutter 11 by an opening projection 1*e* which will be described hereinafter with reference to (d) of FIG. 11 is stopped by the stopper portion 10*e* stopping the unsealing movement of the shutter 11.

One longitudinal end of the accommodating portion 10*a* is provided with a drive gear 12 as a driving means for transmitting a rotational driving force from a driving motor 13 as a driving source which is shown in FIG. 4 and which is provided in the main assembly of the image forming apparatus 100. As will be described hereinafter, the drive gear 12 applies, to a planetary gear 6 shown in (a), (c) and (d) of FIG. 6, a rotational driving force in the same direction as the rotational direction of the developer supply container 1 for unsealing the shutter 11. The rotational driving force is transmitted from the planetary gear 6 to a gear 5.

Figure 6:
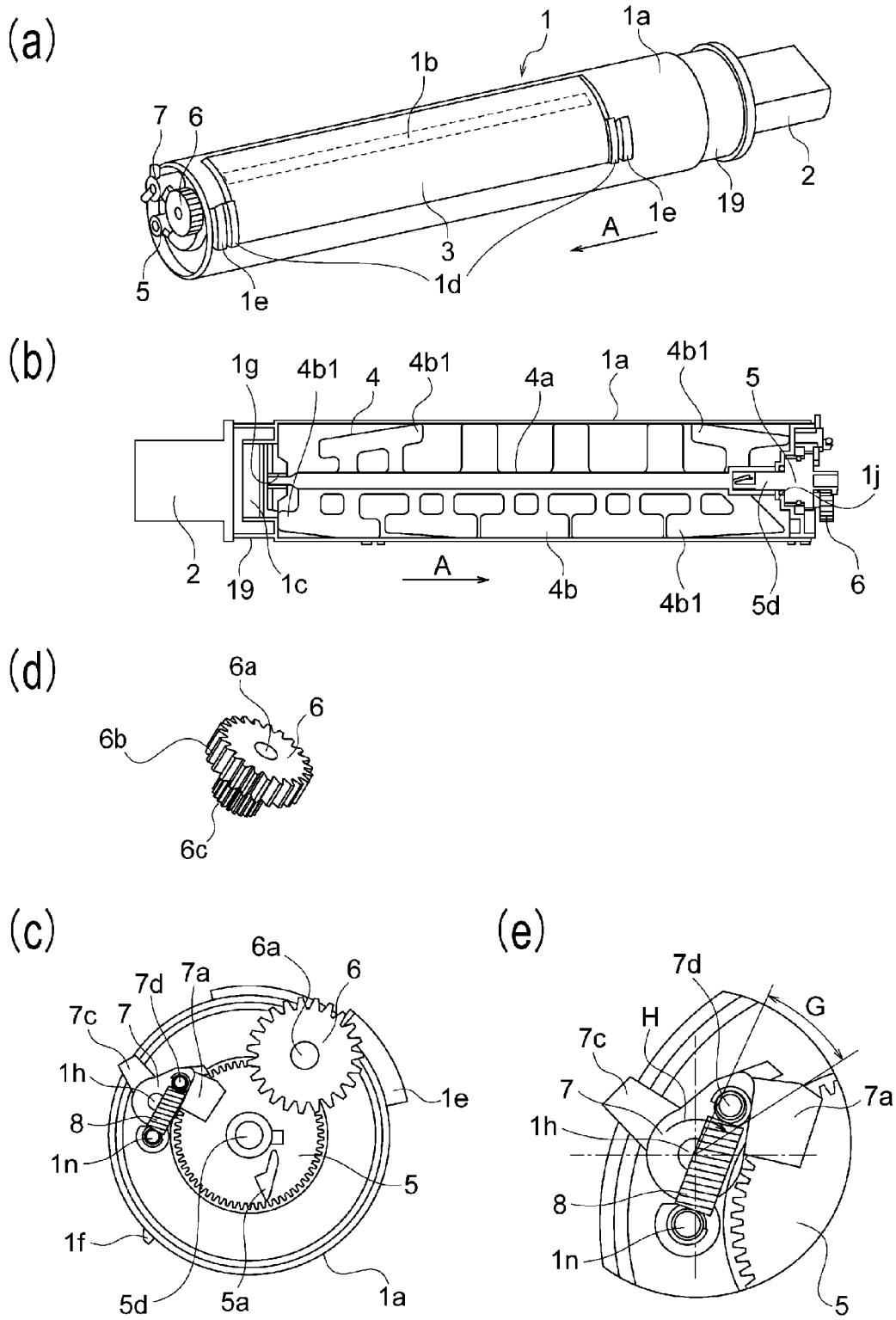
In FIG. 6, (a), (b) and (c) are a perspective illustration, a sectional illustration and a side illustration, respectively, each showing the structure of the developer supply container, (d) is a perspective view showing a structure of a planetary gear constituting a drive transmitting means, and (e) is a partially enlarged view for illustrating an operation of a suppressing means.

As a result, as shown in (b) of FIG. 6, a discharging member 4 as a discharging means including a stirring shaft 4*a* connected with a shaft portion 5*d* of the gear 5 is rotationally driven about the stirring shaft 4*a*. The discharging member 4 is provided rotatably about the stirring shaft 4*a*, so that the developer in the developer supply container 1 to the outside of the developer supply container 1. The planetary gear 6 and the gear 5 are constituted as a drive transmitting means for transmitting the driving force of a driving gear 12 to the discharging member 4.

The driving gear 12 engages with an unshown gear train for rotationally driving the feeding member 201*c* of the developing device 201*a*, the developing roller 201*b* and the photosensitive drum 104 which are shown in FIG. 1. The driving gear 12 in this embodiment is, as shown in (c) of FIG. 11, (c) of FIG. 12 and (a) to (e) of FIG. 13, in module and 17 teeth in number of teeth. The module is a value obtained by dividing a diameter of a pitch circle of the driving gear 12 by the number of teeth.

The developer receiving apparatus 10 is provided with a groove portion 10*h* shown in (a) of FIG. 3. The developer receiving apparatus 10 is further provided with guide portions 10*j* and 10*k* inclined relative to an inserting direction (arrow A direction in (b) of FIG. 3) and a demounting direction (opposite direction to the arrow A direction in (b) of FIG. 3) of the developer supply container 1 shown in (b) of FIG. 3.

The inserting direction of the developer supply container 1 shown as the arrow A direction in (a) and (b) of FIG. 3 is substantially parallel to a longitudinal direction of the developer supply container 1 to be inserted into the developer receiving apparatus 10.

The groove portion 10*h* shown in (a) of FIG. 3 is constituted so that an introducing portion 7*c* shown in (c) and (e) of FIG. 6 slidably passes through the groove portion 10*h* when the developer supply container 1 is mounted in and demounted from the developer receiving apparatus 10. The introducing portion 7*c* switches a locking member 7 as a suppressing means shown in FIG. 19 between an operating position and a non-operating position.

As shown in (b) of FIG. 3, the guide portions 10*j* and 10*k* are provided so as to project toward an inside of the accommodating portion 10*a* of the groove portion 10*h* shown in (a) of FIG. 3.

Figure 9:
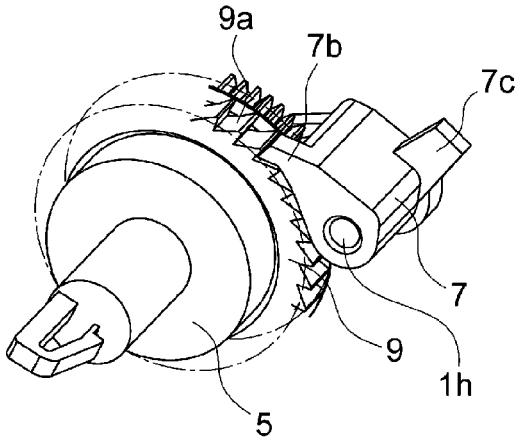
In FIG. 9, (a) is a sectional illustration showing a state in which a large braking torque is generated in the gear constituting the drive transmitting means by moving the suppressing means to an operating position, (b) is a sectional illustration showing a state in which no braking torque is generated in the gear constituting the drive transmitting means by moving the suppressing means to a non-operating position, and (c) is a sectional illustration showing a state in which a small braking torque is generated in the gear constituting the drive transmitting means by moving the suppressing means to the operating position.
Figure 9:
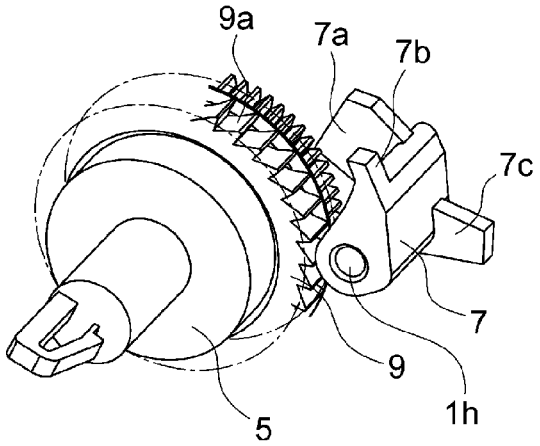
Figure 9:
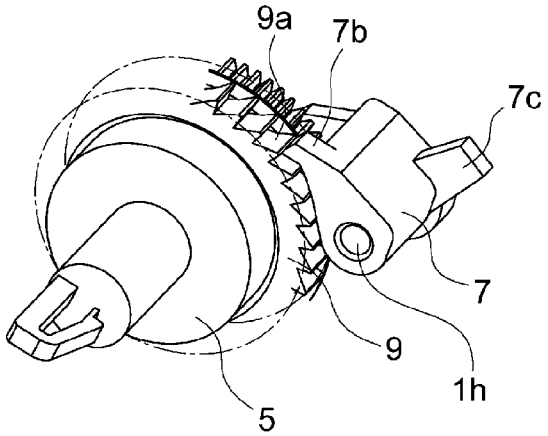

With respect to the guide portions 10*j* and 10*k* shown in (b) of FIG. 3, a locking portion 7*b* which is a locking claw of the locking member 7 shown in (a) to (c) of FIG. 9 is disengaged from a hooking (catching) portion 9*a* consisting of a gear of the fixing member 9 in some cases. In such cases, the introducing portion 7*c* is set so as to slide with the guide portions 10*j* and 10*k* when the introducing portion 7*c* passes through the groove portion 10*h* shown in (a) of FIG. 3.

<Wiping Member>

Using FIGS. 3, 4 and 15, a structure of a wiping member 18, which is a feature of the present invention, for removing the developer deposited on an outer peripheral surface of the developer supply container 1 will be described. As shown in (a) and (b) of FIG. 3, the wiping member 18 is provided in the neighborhood of an upstream side of the developer receiving apparatus 10 at the inner peripheral surface with respect to a mounting direction (arrow A direction in (a) and (b) of FIG. 3) of the developer supply container 1.

Figure 14:
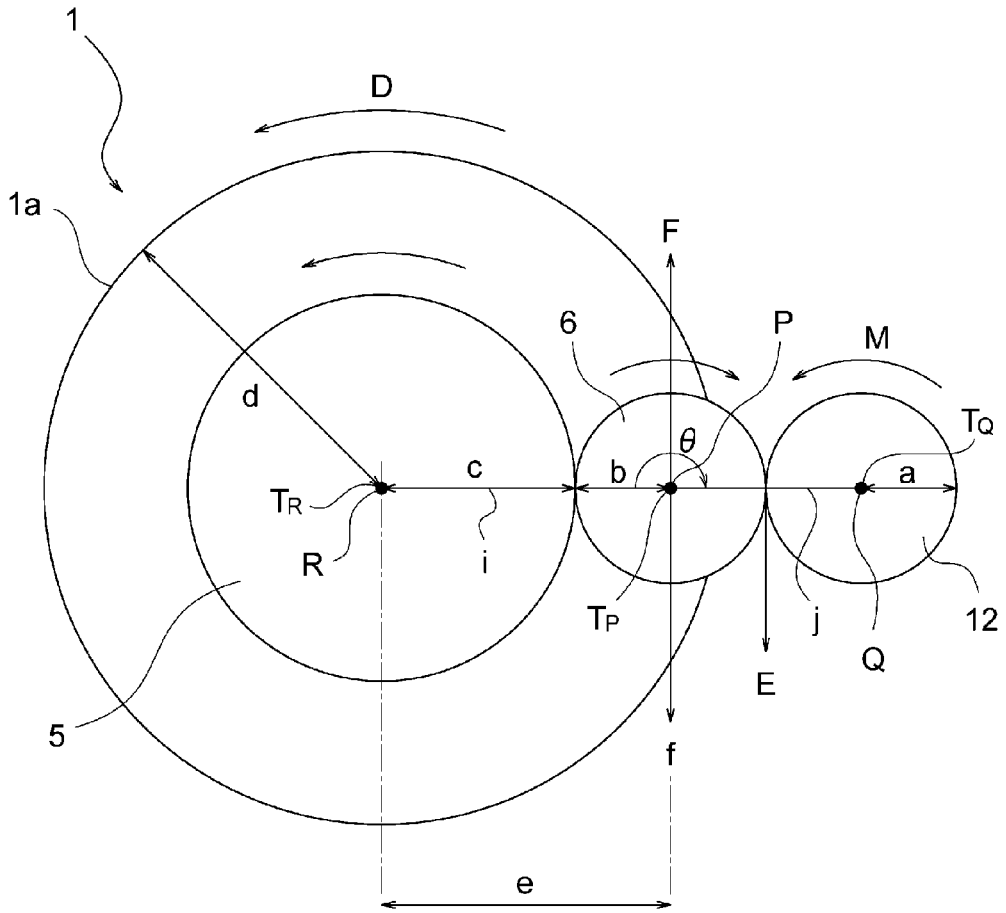
FIG. 14 is a schematic view for illustrating a principle of automatic rotation of the developer supply container.

As shown in (a) and (b) of FIG. 3, the wiping member 18 is, at the inner peripheral surface of the developer receiving apparatus 10, provided in a lower side relative to a rotation center roller of the developer supply container shown in FIG. 14.

Figure 15:
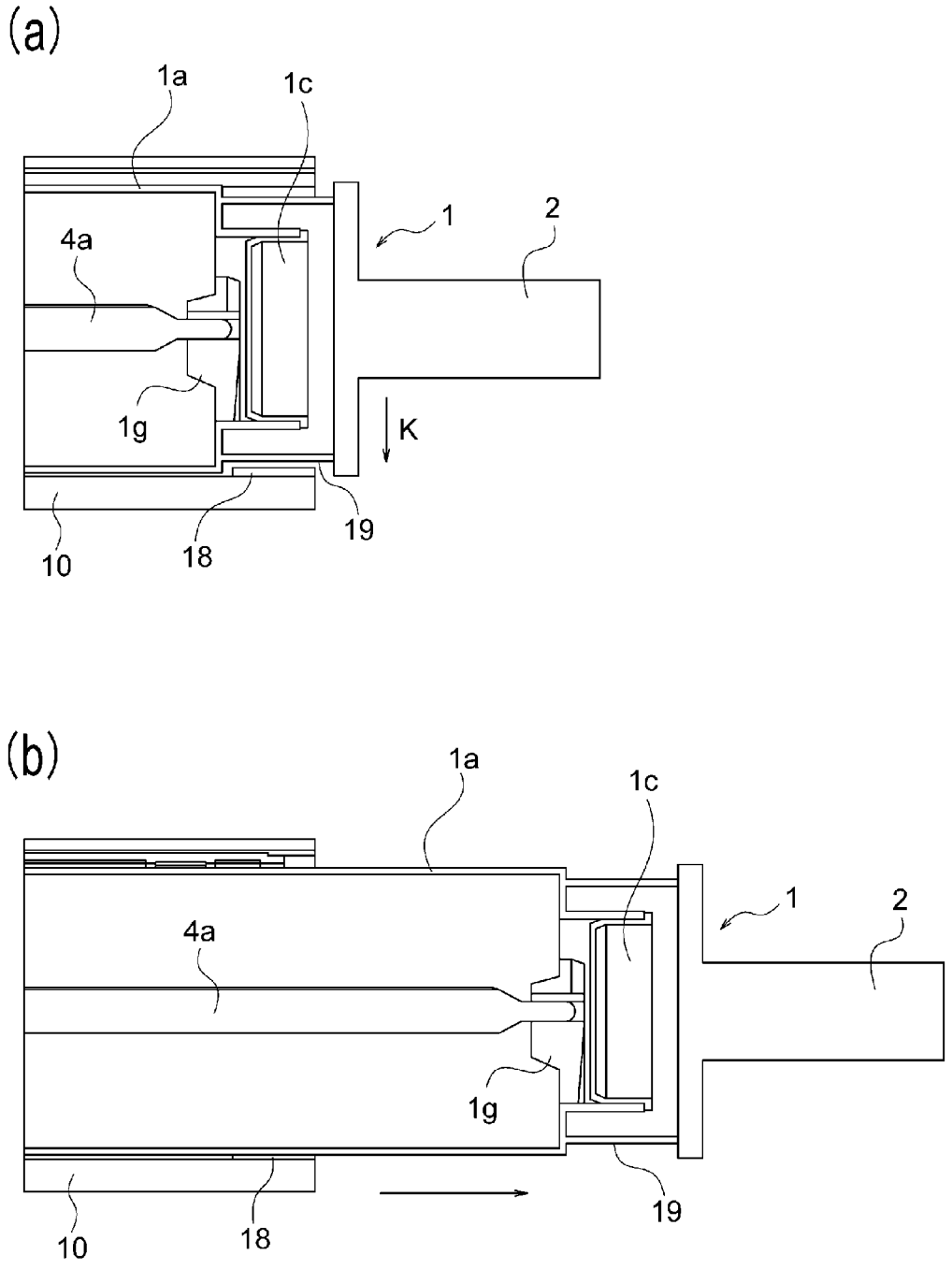
In FIG. 15, (a) is a sectional illustration showing a state in which the developer supply container is inserted and mounted in the developer receiving apparatus provided in the image forming apparatus main assembly, and (b) is a sectional side illustration showing a state in which the developer supply container is demounted from the developer receiving apparatus provided in the image forming apparatus main assembly.

The wiping member 8 is, as shown in (b) of FIG. 15, provided so as to project from the inner peripheral surface toward the inside of the accommodating portion 10*a* of the developer receiving apparatus 10 so as to slide with the outer peripheral surface of the developer supply container 1 when the developer supply container 1 is mounted in and demounted from the developer receiving apparatus 10. The wiping member 18 slides with the outer peripheral surface of the developer supply container 1, thus removing the developer deposited on the outer peripheral surface of the developer supply container 1.

A material for the wiping member 18 may preferably have a low density when a sliding resistance of the developer supply container 1 during mounting and demounting is taken into consideration. For example, as the material for the wiping member 18, it is possible to use a foam member such as a high density polyurethane, or a woven cloth or non-woven cloth using as base fibers, animal fibers such as wool or silk, vegetable fibers such as cotton or hemp, or synthetic fibers such as nylon, polyester, acrylic fiber.

<Developer Supply Container>

As shown in (a) of FIG. 6, with respect to the developer supply container 1, the container body 1*a*, as an accommodating portion for accommodating the developer is roughly cylindrical. The outer peripheral surface of the container body 1*a* is provided with the developer discharge opening 1*b*, which is in the form of a slit which extends in the direction parallel to the longitudinal direction (left-right direction in (a) of FIG. 6) of the container body 1*a*. The container body 1*b* protects the developer accommodated in the during transportation before the developer supply container 1 is used.

The developer supply container 1 has a predetermined rigidity so as to prevent leakage of the developer. In this embodiment, the container body 1*a* is formed of polystyrene as a material therefor by injection molding. Incidentally, the choice of the resinous substance to be used as the material for the container body 1*a* does not need to be limited to polystyrene. For example, other materials, such as acrylonitrile-butadiene-styrene copolymer (ABS) may also be used.

As shown in (a) of FIG. 6, the container body 1*a* is also provided, at a longitudinal end portion (right end portion in (a) of FIG. 6), of the container body 1*a*, a handle 2 as a gripping member gripped by the user during mounting and demounting operation of the developer supply container 1. The handle 2 has a predetermined rigidity similarly as in the case of the container body 1*a*. The handle 2 in this embodiment is prepared using the same material and the same molding method as those for the container body 1*a*.

As for the method for fixing the handle 2 to the container body 1*a*, the handle 2 may be mechanically engaged with the container body 1*a*, or may be attached to the container body 1*a* with the use of screws. Further, it may be fixed to the container body 1*a* by bonding or welding. All that is required of the fixing method is that the method is capable of ensuring a sufficient strength to the extent that the handle 2 is not disconnected even when the user grips the handle 2 during the mounting and demounting operation of the developer supply container 1. In this embodiment, the handle 2 is fixed to the container body 1*a* by being mechanically engaged with the container body 1*a*.

As a modified example of the handle 2, for example, the gear 5 and the planetary gear 6 may also be rotatably provided in the upstream side (handle 2 side) with respect to the inserting direction of the developer supply container 1 shown as the arrow A direction of (b) of FIG. 6. Further, a constitution in which the handle 2 for operation is attached so that a connecting portion where the planetary gear 6 and the driving gear 12 engage with each other is exposed may also be employed. In this case, this constitution is excellent in that the drive transmitting means consisting of the gear 5 and the planetary gear 6 can be protected by the handle 2.

In this embodiment, as shown in (b) of FIG. 6, the gear 5 and the planetary gear 6 are provided in a leading end side (right side in (b) of FIG. 6) of the container body 1*a* with respect to the inserting direction shown as the arrow A direction in (b) of FIG. 6. At an end portion in an opposite side (left side in (b) of FIG. 6) from the side where the gear 5 and the planetary gear 6 are provided, a developer filling opening 1*c* is provided. The developer filling opening 1*c* is sealed with an unshown sealing member or the like after the developer is filled in the container body 1*a*.

The developer discharge opening 1*b* shown in (a) of FIG. 6 is provided at an operative position (position where a setting operation after the developer supply container 1 is mounted to enable supply of the developer is completed) where the developer supply container 1 mounted in the developer receiving apparatus 1 is rotated through a predetermined angle.

The developer discharge opening 1*b* is disposed opposed to a developer receiving opening 10*b* by the shutter 11 provided in the developer receiving apparatus 10 shown in (a) and (b) of FIG. 12. When the developer supply container 1 is mounted in the developer receiving apparatus 10, the developer supply container 1 is mounted in the developer receiving apparatus 10 in a state in which the developer discharge opening 1*b* is directed upward substantially vertically.

<Recessed Portion>

Using FIGS. 6 and 15, a structure of a recessed portion 19, as a feature of the present invention, provided on the outer peripheral surface of the developer supply container 1 will be described. With respect to the longitudinal direction (left-right direction in (a) and (b) of FIG. 6) of the developer supply container 1, the recessed portion 19 is provided in the neighborhood of the upstream side (right side in (a) of FIG. 6) of the mounting direction (arrow A direction in (a) and (b) of FIG. 6) of the developer supply container 1. The recessed portion 19 is provided over a full circumference of the outer peripheral surface of the container body 1*a*.

As shown in (a) of FIG. 15, a length of the recessed portion 19 provided on the outer peripheral surface of the container body 1*a* with respect to the longitudinal direction (left-right direction in (a) of FIG. 15) is as follows. The length is set so as to be larger by a predetermined dimension than a length of the wiping member 18 provided on the inner peripheral surface of the developer receiving apparatus 10 with respect to the longitudinal direction (left-right direction in (a) of FIG. 15) of the developer receiving apparatus 10.

In FIG. 15, (a) is a sectional illustration showing a state in which the developer supply container 1 is mounted in the developer receiving apparatus 10. As shown in (a) of FIG. 15, the recessed portion 19 provided on the outer peripheral surface of the container body 1*a* is constituted so as to oppose the wiping member 18 provided on the inner peripheral surface of the developer receiving apparatus 10 with respect to a radial direction (arrow K direction in (a) of FIG. 15) of the developer supply container 1.

As shown in (a) of FIG. 15, in a state in which the developer supply container 1 is mounted in the developer receiving apparatus 10, it is preferable that the recessed portion 19 and the wiping member 18 are spaced from each other and do not slide with each other. Even in the case where the recessed portion 19 and the wiping member 18 slide with each other in contact with each other, the recessed portion 19 and the wiping member 18 are constituted so that a sliding amount therebetween is smaller than a sliding amount between the wiping member 18 and an outer peripheral surface of the developer supply container 1 other than the recessed portion 19. In this embodiment, as shown in (a) of FIG. 15, a gap is provided between the recessed portion 19 and the wiping member 18 and thus are prevented from sliding with each other.

The recessed portion 19 in this embodiment reduces a sliding load between the outer peripheral surface of the developer supply container 1 and the wiping member 18 when the developer supply container 1 is rotated in the circumferential direction in the state in which the developer supply container 1 is mounted in the developer receiving apparatus 10. The recessed portion 19 in this embodiment is provided in the upstream side (right side in (a) of FIG. 6) of the mounting direction of the developer supply container 1.

<Shutter of Developer Supply Container>

Using (a) of FIG. 6, a structure of a shutter 3 for opening and closing the developer discharge opening 1*b* of the developer supply container 1 will be described. As shown in (a) of FIG. 6, the developer discharge opening 1*b* provided in the container body 1*a* of the developer supply container 1 is openably by the shutter 3 having such a shape that a curvature thereof substantially follows the outer peripheral surface of the container body 1*a*.

The shutter 3 engages with a guide portion 1*d* provided correspondingly to each of end portions thereof with respect to the longitudinal direction (left-right direction in (a) of FIG. 6) of the container body 1, and is slidably supported by the guide portions 1*d*. The guide portions 1*d* guide sliding movement for opening and closing the shutter 3 in the circumferential direction of the container body 1*a*. Further, the guide portions 1*d* prevent the shutter 3 from dislodging from the container body 1*a*.

In order to prevent the developer from leaking from the developer supply container 1, it is desired that an unshown sealing member is provided on the shutter 3 at an opposing surface to the developer discharge opening 1*b*. Or, reversely, the sealing member may also be provided at a periphery of the developer discharge opening 1*b* of the container body 1*a*. Or, both the shutter 3 and container body 1*a* may also be provided with the sealing member. In this embodiment, only at the periphery of the developer discharge opening 1*b* of the container body 1*a*, the sealing member is provided.

Different from this embodiment, a constitution in which the shutter 3 is not provided, but the developer discharge opening 1*b* may be hermetically sealed by attaching an unshown sealing film formed of resin to the periphery of the developer discharge opening 1*b* of the container body 1*a* through welding or the like, and then this sealing film is peeled away to unseal the developer discharge opening 1*b* (developer supply container 1) may also be employed.

In the case of this structural arrangement however, there is a possibility that when the developer supply container 1, which has become depleted of developer, is replaced, a small amount of developer which is still remaining in the developer supply container 1 will come out of the developer discharge opening 1*b* and scatter. For this reason, it is desired to employ the constitution as in this embodiment in which the developer discharge opening 1*b* can be resealed with the shutter 3.

Incidentally, depending on the shape of the developer discharge opening 1*b* provided in the container body 1*a* and a filling amount of the developer in the container body 1*a*, the developer leaks in some cases during transportation of the developer supply container 1 before the developer is supplied. In such cases, by providing both of the sealing film and the shutter 3 described above, it is possible to ensure a stronger sealing performance.

<Discharging Member>

Using FIGS. 1 and 6, a structure of a discharging member 4 for feeding the developer in the container body 1*a* of the developer supply container 1 while stirring the developer will be described. As shown in (b) of FIG. 6, inside the container body 1*a*, the discharging member 4 of which a stirring blade 4*b* rotates about a stirring shaft 4*a* is provided. The discharging member 4 is constituted principally by including the stirring shaft 4*a* and the stirring blade 4*b*.

By rotation of the discharging member 4, the developer in the container body 1*a* is feed toward the developer discharge opening 1*b* shown in (a) of FIG. 6 while being stirred. The developer stirred and fed by the stirring blade 4*b* is discharged to the outside through the developer discharge opening 1*b*.

As shown in (b) of FIG. 6, an end portion (left end portion in (b) of FIG. 6) of the stirring shaft 4*a* of the discharging member 4 with respect to the longitudinal direction is shaft-supported rotatably by a bearing portion 1*g* provided in the container body 1*a*. The discharging member 4 is provided so that movement thereof in a rotational axis direction (left-right direction in (b) of FIG. 6) cannot be made substantially.

On the other hand, as shown in (b) of FIG. 6, the other end portion (right end portion in (b) of FIG. 6) of the stirring shaft 4*a* of the discharging member 4 with respect to the longitudinal direction (left-right direction in (b) of FIG. 6) is constituted as follows. A shaft portion 5*d* is connected coaxially with the gear 5 shaft-supported rotatably by a bearing portion 1*j* provided in the container body 1*a* so as to be rotatable integrally with the gear 5.

Specifically, inside the container body 1*a*, the shaft portion 5*d* of the gear 5 and the other end portion (right portion in (b) of FIG. 6) of the stirring shaft 4*a* are locked with each other, so that connection therebetween is made.

In order to prevent the developer from leading from the periphery of the shaft portion 5*d* of the gear 5 to the outside, the outer peripheral surface of the shaft portion 5*d* is provided with a sealing member. Incidentally, instead of a directly connecting constitution between the shaft portion 5*a* of the gear 5 and the stirring shaft 4*a*, the two may also be indirectly drive-connected to each other via an unshown connecting member provided therebetween.

Even in the case where the developer in the container body 1*a* solidifies, it is desired that the stirring shaft 4*a* of the discharging member 4 is rigid enough to loosen the solidified developer by the stirring blade 4*b* to stir and feed the developer toward the developing apparatus 201 side shown in FIG. 1. Further, it is desired that a sliding resistance of the surface of the stirring shaft 4*a* with the shaft portion 1*g* of the container body 1*a* shown in (b) of FIG. 6 is small to the possible extent. In this embodiment, polystyrene is employed as the material for the stirring shaft 4*a* from the above-described viewpoints. The material for the stirring shaft 4*a* does not need to be limited to polystyrene, but other substances such as polyacetal may also be employed.

The stirring blade 4*b* of the discharging member 4 is firmly secured to the stirring shaft 4*a*. The developer in the container body 1*a* is fed toward the developer discharge opening 1*b* shown in (a) of FIG. 6 while stirring the developer with rotation of the stirring shaft 4*a*. In order to reduce the amount of the developer which remains in the container body 1*a*, as shown in (b) of FIG. 6, the leading end portion 4*b*1 of the stirring blade 4*b* has a projecting length to the extent that the leading end portion 4*b*1 of the stirring blade 4*b* properly slides with the inner peripheral surface of the container body 1*a*.

As shown in (b) of FIG. 6, the leading end portions 4*b*1 of the stirring blade 4*b* is inclined roughly in L-shape. The developer in the container body 1*a* is fed in the longitudinal direction (left-right direction in (b) of FIG. 6) of the container body 1*a* toward the developer discharge opening 1*b* shown in (a) of FIG. 6 using delay of rotation of these roughly L-shaped inclined leading end portion.

In this embodiment, the stirring blade 4*b* is formed of a sheet of polyester. The material for the stirring blades 4*b* does not need to be limited to a sheet of polyester, but other various substances may also be employed, as long as a sheet formed of a selected substance is a flexible resin sheet.

As the structure of the discharging member 4, various structures can also be employed, as long as the discharging member 4 feeds the developer to the outside of the developer supply container 1 by being rotated. For example, the above-described discharge member 4 can be modified in the material, shape, etc., of the stirring blade 4*b*. Further, a feeding mechanism different in constitution from the above-described discharging member 4 may also be employed. In this embodiment, the gear 5 and the discharging member 4 which are separate components are integrated into a single piece by being locked with each other. In addition, the gear 5 and the stirring shaft 4*a* may be integrally molded of resin.

<Mechanism for Opening of Closing Shutter for Developer Receiving Apparatus>

Next, a structure of the shutter 11 for opening or closing the developer receiving opening 10*b* provided in the developer receiving apparatus 10 will be described using FIGS. 5 and 6.

As shown in (a) and (b) of FIG. 6, the container body 1*a* is provided on the outer peripheral surface thereof with an unsealing projection 1*e* and a sealing projection 1*f* which are an interrelating portion for performing an opening and closing operation of the shutter 11 for opening and closing the developer receiving opening 10*b* provided in the developer receiving apparatus 10 shown in (a) and (b) of FIG. 5.

The unsealing projection 1*e* presses down the shutter 11 shown in (a) and (b) of FIG. 5 to unseal the developer receiving opening 10*b* during an operation for rotating developer supply container 1 toward an operative position (replenishment (supply) position) through a predetermined angle, as a setting operation after the mounting of the developer supply container 1.

As a demounting operation of the developer supply container 1, the rotates the developer supply container 1 in an opposite direction by a predetermined angle from the operative position (replenishment position) to a position where the developer supply container 1 is mountable and demountable. During the operation, the developer receiving opening 10*b* is hermetically sealed by pushing up the shutter 11 shown in (a) and (b) of FIG. 5.

In this way, an opening and closing operation of the shutter 11 is interrelated with the rotating operation of the developer supply container 1. For this reason, the unsealing projection 1*e* and the sealing projection 1*f* are provided on the container body 1*a* so as to provide the following positional relationship. That is, they are positioned so that when the developer supply container 1 shown in (a) of FIG. 6 is mounted in the developer receiving apparatus 10 shown in (a) and (b) of FIG. 5, the unsealing projection 1*e* is on the upstream side of the shutter 11 with respect to the rotational direction of the shutter 11 during unsealing. On the other hand, the sealing projection 1*f* shown in (c) of FIG. 6 is on the downstream side of the shutter 11 with respect to the rotational direction of the shutter 11 during unsealing.

<Drive Transmitting Means>

Next, structures of the gear 5 and the planetary gear 6 which constitute the drive transmitting means for transmitting the rotational driving force transmitted to the driving gear 12, to the discharging member 4 provided in the developer supply container 1 will be described using FIGS. 4, 6, 10-12 and 14.

To the driving gear 12 rotatably provided on the developer receiving apparatus 12, the rotational driving force is transmitted from a motor 13 as a driving source provided in the main assembly of the image forming apparatus 100 shown in FIG. 4 via an unshown gear train.

As shown in FIG. 4, the developer receiving apparatus 10 is rotatably provided with the driving gear 12 which is a driving means for providing the rotational driving force to the discharging member 4 rotatably provided in the developer supply container 1.

On the other hand, the developer supply container 1 is rotatably provided with the gear 5 and the planetary gear 6 which constitute the drive transmitting means for transmitting, to the discharging member 4 rotatably provided in the developer supply container 1, the rotational driving force received from the driving gear 12. As shown in (c) of FIG. 12, the planetary gear 6 engages and drive-connects with the driving gear 12 provided rotatably in the developer receiving apparatus 10. The planetary gear 6 engages with the gear 5, so that the rotational driving force received from the driving gear 12 is transmitted to the discharging member 4.

In this embodiment, the rotational driving force is transmitted from the driving gear 12 provided on the developer receiving apparatus 10 to the discharging member 4 provided in the developer supply container 1 by the planetary gear 6 and the gear 5, always engaging with the planetary gear 6, which constitute the drive transmitting means.

The planetary gear 6 is, as shown in (c) of FIG. 12 and FIG. 14, engageable with the driving gear 12 by being revolved about, as a revolving axis, a rotation center R of the container body 1*a* of the developer supply container 1.

The shaft portion 5*d* of the gear 5 is, as shown in (b) of FIG. 6, provided rotatably about the bearing portion 1*j* provided on an end surface (right end surface in (b) of FIG. 6) with respect to the longitudinal direction (left-right direction in (b) of FIG. 6) of the developer supply container 1. The shaft portion 6*a* of the planetary gear 6 is provided rotatably about an unshown bearing portion provided on the end surface (right end surface in (b) of FIG. 6) with respect to the longitudinal direction (left-right direction in (b) of FIG. 6) of the developer supply container 1. As shown in (b) of FIG. 6, to the shaft portion 5*d* of the gear 5, an end of the stirring shaft 4*a* of the discharging member 4 is connected.

In this embodiment, by the user, the developer supply container 1 is inserted into the developer receiving apparatus 10 provided in the main assembly of the image forming apparatus 100 in the arrow A direction of FIG. 10, and thus is mounted in the operative position (replenishment position). During the mounting and demounting operation of the developer supply container 1, the user grips the handle 2 and rotates the developer supply container 1 in an arrow B direction (circumferential direction) in (c) of FIG. 11 through a predetermined angle.

Before the rotation of the developer supply container 1, as shown in (c) of FIG. 11, the planetary gear 6 provided in the developer supply container 1 and the driving gear 12 provided on the developer receiving apparatus 10 are in the following state. The two gears are in a spaced state from each other with respect to the circumferential direction of the developer receiving apparatus 10 and the developer supply container 1, and are not engaged with each other, and therefore the gears are not drive-connected with each other.

Thereafter, the user grips the handle 2 and rotates the developer supply container 1 in the arrow B direction (circumferential direction) in (c) of FIG. 11 through the predetermined angle. As a result, as shown in (c) of FIG. 12, the planetary gear 6 provided in the developer supply container 2 and the driving gear 12 provided on the developer receiving apparatus 10 are engaged and drive-connected with each other.

In this embodiment, the gear 5 with which the stirring shaft 4*a* of the discharging member 4 and the shaft portion 5*d* are connected is constituted as follows. The gear 5 is shaft-supported on one end surface (left end surface in (a) of FIG. 6) with respect to the longitudinal direction (let-right direction in (a) of FIG. 6) of the container body 1*a* shown in (a) of FIG. 6 so as to be rotatable about the rotation center R of the developer supply container 1. The gear 5 is provided so as to be coaxially rotatable with the rotation center of the stirring shaft 4*a* of the discharging member 4.

The gear 5 is mounted so that its rotation center R substantially coincides with the rotation center R of the container body 1*a* when the developer supply container 1 is rotated in the arrow B direction (circumferential direction) in (c) of FIG. 11 during the mounting operation of the developer supply container 1.

The planetary gear 6 is, as shown in (c) of FIG. 6, constituted as a two-stage gear having a large-diameter portion 6*b* and a small-diameter portion 6*c*. As shown in FIG. 14, a rotation center P of the shaft portion 6*a* of the planetary gear 6 is disposed at a position eccentric from the rotation center of the developer supply container 1.

As shown in FIG. 14, the planetary gear 6 is not only revolved about, as the revolving axis, the rotation center R of the developer supply container 1 but also shaft-supported by the developer supply container 1 so as to be rotatable about the rotation center P as an axis of rotation.

The large-diameter portion 6*b* of the planetary gear 6 shown in (b) of FIG. 6 engages is provided so as to be drive-connectable with the driving gear 12 provided on the developer receiving apparatus 10 by being engaged with the driving gear 12, and thus receives the rotational driving force from the driving gear 12. The small-diameter portion 6*c* of the planetary gear 6 is provided so as to be drive-connectable with the gear 5 by being engaged with the gear 5, and thus transmits the rotational driving force to the gear 5.

The planetary gear 6 engages with the driving gear 12 for imparting a rotational force thereto in an opposite direction to the rotational direction shown as the arrow B direction in (c) of FIG. 11 during the mounting operation of the developer supply container 1. By the engagement, the planetary gear 6 is rotated in the same direction as the rotational direction (arrow B direction in (c) of FIG. 11) during the mounting operation of the developer supply container 1.

The rotational direction shown as the arrow B direction in (c) of FIG. 11 during the mounting operation of the developer supply container 1 is the same direction as the rotational direction shown as the arrow B direction in (b) of FIG. 11 in which the shutter 11 shown in (b) of FIG. 11 is to be opened (unsealed).

As shown in (c) of FIG. 12, the large-diameter portion 6*b* of the planetary gear 6 provided in the developer supply container 1 and the driving gear 12 provided on the developer receiving apparatus 10 are engaged with each other, so that the rotational driving force is inputted from the driving gear 12 into the planetary gear 6. Then, the gear 5 is rotated by engagement between the small-diameter portion 6*c* of the planetary gear 6 and the gear 5, so that the discharging member 4 provided inside the container body 1*a* rotates in the circumferential direction of the container body 1*a* via the shaft portion 5*d* of the gear 5 and the stirring shaft 4*a* connected with the shaft portion 5*d*.

The planetary gear 6 is constituted as follows at the time when the developer supply container 1 is mounted in the developer receiving apparatus 10. As shown in (c) of FIG. 11, the planetary gear 6 is in a spaced state from the driving gear 12 provided on the developer receiving apparatus 10 with respect to the circumferential direction of the developer receiving apparatus 10 and the developer supply container 1 and thus is not engaged with the driving gear 12, and therefore the planetary gear 6 is not drive-connected with the driving gear 12.

Thereafter, the user grips the handle 2 and performs the rotating operation of the developer supply container 1 as shown in (a) of FIG. 12 in the arrow B direction shown in (c) of FIG. 11. Then, as shown in (c) of FIG. 12, the large-diameter portion 6*b* of the planetary gear 6 engages with the driving gear 12 and thus in a drive-connected state. At this time, as shown in (b) of FIG. 11, the shutter 11 is in a closed state, so that the developer discharge opening 1*b* is not in a communication state with the developer receiving opening 10*b*.

Thereafter, as shown in FIG. 5, the motor 13 is drive-controlled by a CPU (central processing unit) 20 as a container means provided in the image forming apparatus 100. Then from the motor, the rotational driving force is inputted into the driving gear 12 provided rotatably on the developer receiving apparatus 10 via an unshown gear train.

A position arrangement of the planetary gear 6 relative to the developer supply container 1 (unsealing projection 1*e* and developer discharge opening 1*b*) with respect to the circumferential direction is adjusted. As a result, timing of the start of drive-connection between the large-diameter portion 6*b* of the planetary gear 6 and the driving gear 12 is appropriately set. The rotation center P of the shaft portion 6*a* of the planetary gear 6 and the rotation center R of the shaft portion 5*d* of the gear 5 are disposed at positions different from each other.

In this embodiment, the container body 1*a* is constituted in a hollow cylindrical shape. For this reason, the rotation center R of the stirring shaft 4*a* of the discharging member 4 and the rotation center R of the container body 1*a* coincide with each other. Further, the rotation center R of the gear 5 including the shaft portion 5*d* connected with the stirring shaft 4*a* of the discharging member 4 coincides with the rotation center R of the container body 1*a*.

On the other hand, the rotation center P of the shaft portion 6*a* of the planetary gear 6 and the rotation center R of the shaft portion 5*d* of the gear 5 are disposed at different positions. Further, with the rotation of the developer supply container 1 in the circumferential direction shown as the arrow B direction in (c) of FIG. 11, the planetary gear 6 is revolved about, as the center of rotation, the rotation center R of the container body 1*a*. As a result, as shown in (c) of FIG. 12, the large-diameter portion 6*b* of the planetary gear 6 is engaged and drive-connected with the driving gear 12 provided on the developer receiving apparatus 10. For this reason, the rotation center P of the shaft portion 6*a* of the planetary gear 6 is disposed at the position different from the position of the rotation center R of the container body 1*a*.

In this embodiment, the constitution in which the rotation center R of the stirring shaft 4*a* of the discharging member 4 and the rotation center R of the container body 1*a* coincide with each other was employed. Another constitution in which the rotation center of the stirring shaft 4*a* of the discharging member 4 and the rotation center of the container body are disposed at different positions may also be employed. For example, the rotation center of the stirring shaft 4*a* of the discharging member 4 may also be disposed close to the developer discharge opening 1*b* in the radial direction of the container body 1*a* shown in (b) of FIG. 12.

In the case where the rotation center of the stirring shaft 4*a* of the discharging member 4 is disposed close to the developer discharge opening 1*b* in the radial direction of the container body 1*a* shown in (b) of FIG. 12, the gear 5 is decreased in diameter and the rotation center of the gear 5 is disposed at a position different from the position of the rotation center R of the container body 1*a*.

In the case where the rotation center of the stirring shaft 4*a* of the discharging member is disposed at the position different from the position of the rotation center of the container body 1*a*, the gear 5 is omitted and only the planetary gear 6 is used as the drive transmitting means, and the stirring shaft 4*a* of the discharging member 4 can also be connected with the shaft portion 6*a* of the planetary gear 6.

A constitution in which the rotation center P of the shaft portion 6*a* of the planetary gear 6 may also be disposed at not only a position eccentric from the rotation center R of the container body 1*a* but also a position corresponding to the rotation center of the stirring shaft 4*a* of the discharging member 4 so as to be shaft-supported by the container body 1*a* may also be employed. At this time, the planetary gear 6 is rotatably connected with the discharging member 4 so that the rotation center P of the planetary gear 6 is coaxially aligned with the rotation center of the discharging member 4.

In the constitution in which the gear 5 is omitted and only the gear 5 is used as the drive transmitting means, in the case the driving gear 12 is rotated in the same direction as that in this embodiment, the rotational direction of the discharging member 4 is opposite to the rotational direction in this embodiment in which the gear 5 is provided.

For this reason, the developer is fed downward toward the developer discharge opening 1*b* of the container body 1*a* shown in (a) of FIG. 6 from the top portion of the container body 1*a*. In this case, in the constitution of the discharging member 4, the developer in the container body 1*a* is raised upward in (a) of FIG. 6 by rotating the container body 1*a* about its own axis. The discharging member 4 may desirably have a function of guiding the raised developer toward the developer discharge opening 1*b* positioned at a lower portion in (a) of FIG. 6.

It is desired that the gear 5 and the planetary gear 6 which are provided in the developer supply container 1 have the function of sufficiently transmitting the rotational driving force transmitted thereto from the driving gear 12 provided on the developer receiving apparatus 10. In this embodiment, polyacetal is employed as the material for the gears 5 and 6, and they were constituted as gears made by injection molding.

The gear 5 in this embodiment is 0.5 in module (value obtained by dividing a diameter of a pitch circle by the number of tooth), 60 in number of tooth, and 30 mm in outer diameter. The large-number portion 6*b* of the planetary gear 6 is 1 in module, 10 in number of tooth, and 20 mm in outer diameter.

The small-diameter portion 6*c* of the planetary gear 6 is 0.5 in module, 20 in number of tooth, and 10 mm in outer diameter. The rotation center P of the shaft portion 6*a* of the planetary gear 6 is provided at a position eccentric (deviated)

by 20 mm from the rotation center R of the shaft portion 5*d* of the gear 5 in the radial direction.

Incidentally, all that is necessary here is that the module, tooth count, and diameter of each of the gear 5 and the planetary gear 6 are set in consideration of a drive transmitting property of the rotational driving force transmitted from the driving gear 12, and they do not need to be limited to those described above.

For example, in order to further increase the developer discharge speed (rotational speed of the discharging member 4), all that is necessary is to reduce the diameter of the gear 5 and increase the diameter of the small-diameter portion 6*c* of the planetary gear 6. On the other hand, in the case where the torque is increased, all that is necessary is to increase the diameter of the gear 5 and reduce the diameter of the small-diameter portion 6*c* of the planetary gear 6. In this way, the constitutions of the gear 5 and the planetary gear 6 can be appropriately selected according to required specifications.

Incidentally, in this embodiment, the developer supply container 1 may also be constituted so that when the developer supply container 1 is viewed from the longitudinal direction thereof, the planetary gear 6 partially protrudes from the outer peripheral surface of the container body 1*a*, as shown in (c) of FIG. 6. Another constitution in which the developer supply container 1 is disposed so that the planetary gear 6 does not protrude from the outer peripheral surface of the container body 1*a* may also be employed. In this case, a packing property when the developer supply container 1 is packaged by a packing material is improved, so that during transportation or the like, the planetary gear 6 protruding from the outer peripheral surface of the container body 1*a* is prevented from being broken when the developer supply container 1 is accidentally dropped.

<Assembling Method of Developer Supply Container>

Using FIG. 6, an assembling method of the developer supply container 1 in this embodiment will be described. First, the discharging member 4 is inserted into the container body 1*a* shown in (b) of FIG. 6. Then, after the gear 5 and the shutter 3 which are shown in (a) of FIG. 6 are attached to the container body 1*a*, the planetary gear 6 consisting of the two-stage gear in which the large-diameter portion 6*b* and the small-diameter portion 6*c* are assembled into a unit is attached to the container body 1*a*.

Thereafter, developer is filled into the container body 1*a* through the developer filling opening 1*c* shown in (b) of FIG. 6, and the developer filling opening 1*c* is sealed with an unshown sealing member. Lastly, as shown in (a) and (b) of FIG. 6, the handle 2 is attached to the end portion of the container body 1*a*.

The above described order in which a step of filling the developer into the container body 1*a* through the developer filling opening 1*c*, and a step of attaching the planetary gear 6, the shutter 3 and the handle 2 can be appropriately changed for the ease of assembly.

In this embodiment, a hollow cylindrical container which is 50 mm in inner diameter and 320 mm in length is used as the container body 1*a*, so that the container body 1*a* is about 600 cc ($\pi\times(50\text{ mm}/2)^2\times320\text{ mm}$) in volumetric capacity. Further, the filling amount of the developer is 300 g.

<Suppressing Means>

The developer supply container 1 in this embodiment is constituted so that the developer supply container 1 is rotated automatically by a predetermined angle toward the operative position (replenishment position) by the rotational driving force from the driving gear 12 provided on the developer receiving apparatus 10. Then, after the automatic rotation, a force required for rotating the developer supply container 1 becomes small.

The developer supply container 1 in this embodiment is automatically rotated by the predetermined angle toward the operative position (replenishment position) in the circumferential direction by the rotational driving force received from the driving gear 12. For that purpose, a locking member 7 as a suppressing means movable between an operating position where rotation of the drive transmitting means relative to the developer supply container 1 is suppressed and a non-operating position is provided.

The locking member 7 is constituted so as to movable between the operating position where the rotations of the gear 5 and the planetary gear 6 which constitute the drive transmitting means relative to the developer supply container 1 is suppressed and the non-operating position where the locking member 7 is retracted from this operating position and the relative rotation is not suppressed. In this embodiment, switching of the locking member 7 from the operating position to the non-operating position is also constituted so as to be automatically made.

Using FIGS. 6-9 and 14, a structure of the locking member 7 will be described. In this embodiment, the developer supply container 1 is automatically rotated toward the operative position (replenishment position). As a mechanism therefor, the planetary gear 6 and the gear 5 which constitute the drive transmitting means for transmitting the rotational driving force from the driving gear 12 provided on the developer receiving apparatus 10 to the discharging member 4 provided in the developer supply container 1 was used. As a result, the structure is intended to be simplified.

Figure 7:
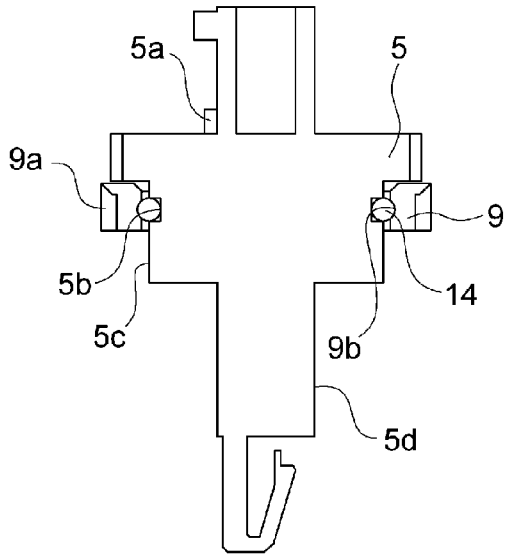
In FIG. 7, (a) and (b) are a sectional illustration and an exploded perspective view, respectively, each showing a structure of a braking member for generating a braking torque in a gear constituting the drive transmitting means by the suppressing means.
Figure 7:
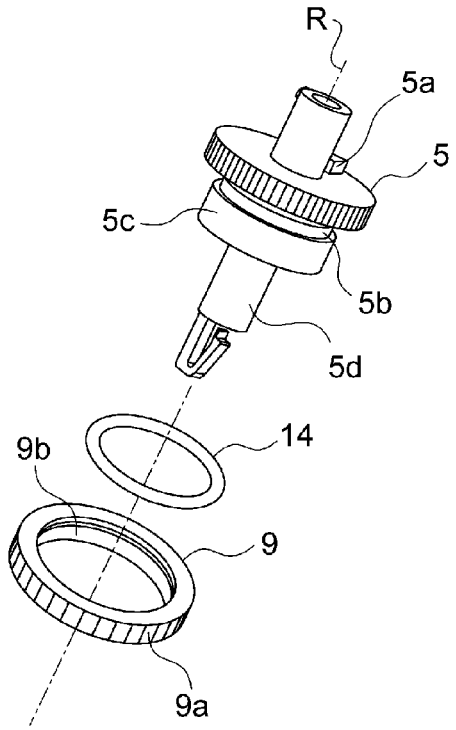

In this embodiment, the drive transmitting means, consisting of the planetary gear 6 and the gear 5, for transmitting the rotational driving force of the driving gear 12 provided on the developer receiving apparatus 10 is provided. Further, a torque generating mechanism using a fixing member 9 and a ring member 14 which are shown in (a) and (b) of FIG. 7 are provided. By this torque generating mechanism, a force for pulling the container body 1*a* to automatically rotate the container body 1*a* toward its operative position (replenishment position).

Specifically, the rotational load (braking torque) of the planetary gear 6 relative to the container body 1*a* is increased by increasing the rotational load (braking torque) of the gear 5 relative to the container body 1*a*. That is, as shown in FIG. 14, the rotational driving force is inputted from the driving gear 12 into the planetary gear 6 which is in mesh with the driving gear 12. At that time, the planetary gear 6 is in a state in which the rotation thereof relative to the container body 1*a* is suppressed (limited).

As a result, a rotating force f about the rotation center R generates in the container body 1*a* via the planetary gear 6 engaging with the driving gear 12. As a result, the container body 1*a* automatically rotates toward its operative position (replenishment position).

When the developer supply container 1 is automatically rotated, the relative rotation between the developer supply container 1 and the combination of the planetary gear 6 and the gear 5 which constitute the drive transmitting means is suppressed (limited). Such a suppressing means is constituted by the locking member 7 shown in (a) to (c) of FIG. 9, and the fixing member 9 and the ring member 14 which are shown in (a) and (b) of FIG. 7.

In this embodiment, the rotational load (braking torque) of the planetary gear 6 and the gear 5 which constitute the drive transmitting means exerted on the developer supply container 1 is set so as to be larger than the force for automatically rotating the developer supply container 1.

In this embodiment, a constitution in which a braking force is caused to act on the gear 5 by the suppressing means consisting of the locking member 7 shown in (a) to (c) of FIG. 9, and the fixing member 9 and the ring member 14 which are shown in (a) and (b) of FIG. 7 will be described. Another constitution in which the braking force is caused to act on the planetary gear 6 by a similar suppressing means may also be employed.

As shown in (a) and (b) of FIG. 7, a circumferential surface 5*c* of the gear 5 is provided with a recessed portion 5*b* over full circumference, and the ring member 14 consisting of an O-ring is engaged in the recessed portion 5*b*. A ring-shaped fixing member 9 is fitted (engaged) with the outer peripheral surface of the ring member 14.

The fixing member 9 is constituted rotatably about the rotational center R of the gear 5 relative to the gear 5. A saw-teeth-like hooking (catching) portion 9*a* is provided over a full circumference of the outer peripheral surface of the fixing member 9.

The ring member 14 consisting of the O-ring is provided in a compressed state between the outer circumferential (peripheral) surface 5*c* of provided as a part of the shaft portion 5*d* of the gear 5 and the inner circumferential (peripheral) surface 9*b* of the fixing member 9. The ring member 14 is engaged and fixed in the recessed portion 5*b* formed at the outer circumferential surface 5*c* of the gear 5. Therefore, when the fixing member 9 is rotated relative to the gear 5, the braking torque is generated due to the sliding between the inner circumferential surface 9*b* of the fixing member 9 and the compressed ring member 14.

In this embodiment, the saw-teeth-like catching portion 9*a* is provided over the full circumference on the outer peripheral surface of the fixing member 9. In another example, the catching portion 9*a* may also be provided in at least one position on the outer peripheral surface of the fixing member 9. Further, the catching portion 9*a* may also be in the form of a projection or a recess.

It is desired that an elastic substance, such as rubber, felt, foamed substance, urethane rubber, elastomer, etc., is used as the material for the ring member 14. In this embodiment, silicon rubber is used. Further, a member in the form of a non-ring, such as a member from which a part of the outer peripheral surface is omitted or the like member may also be employed as the ring member 14.

In this embodiment, in the recessed portion 5*b* provided on the outer circumferential surface 5*c* provided as a part of the shaft portion 5*d* of the gear 5, the ring member 14 is engaged and fixed. As another fixing method, for example, a constitution in which the ring member 14 is not fixed in the gear 5 side but is fixed in the fixing member 9 side and in which the outer circumferential surface 5*c* of the gear 5 and the ring member 14 are caused to slide relative to each other to generate the braking torque may also be employed. Further, the ring member 14 and the gear 5 may also be integrally formed into a unit by integral molding (two-color molding/different-material molding).

As shown in (c) of FIG. 6, the container body 1*a* is provided with a shaft 1*h* which protrudes from the end surface (left end surface in (a) of FIG. 6) of the container body 1*a* with respect to the longitudinal direction (left-right direction in (a) of FIG. 6) of the container body 1*a*. The locking member 7 is provided rotatably (displaceably) about the shaft 1*h*. The locking member 7 is constituted as the suppressing means for suppressing rotation of the fixing member 9 in contact with the catching portion 9*a* of the fixing member 9 shown in (a) and (b) of FIG. 7.

Figure 8:
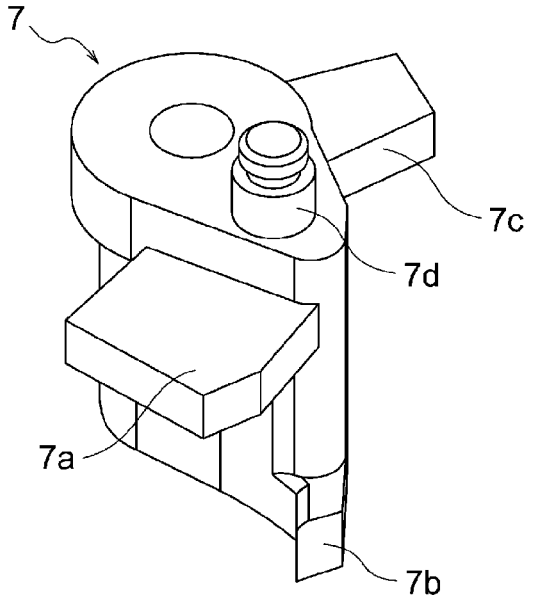
In FIG. 8, (a) and (b) are perspective illustrations each showing a structure of the suppressing means.
Figure 8:
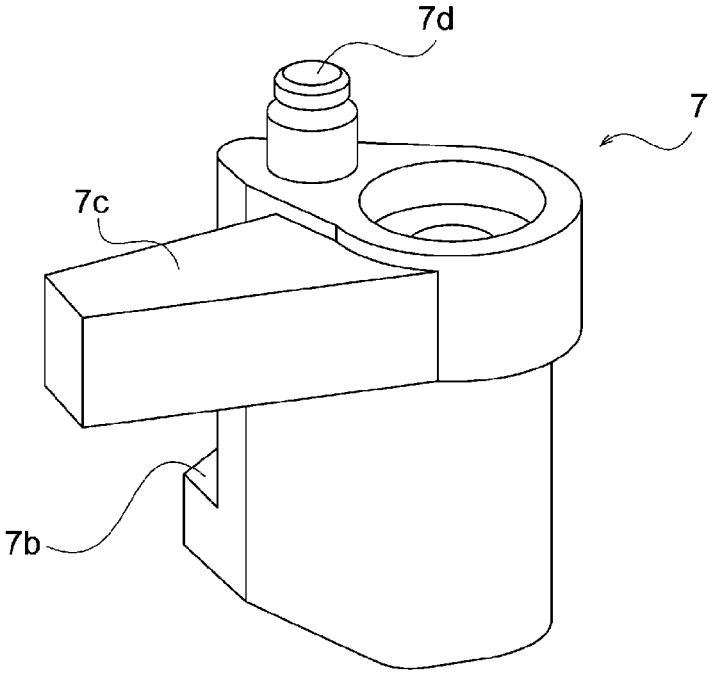

As shown in (a) of FIG. 8, the locking member 7 includes a portion-to-be-released 7*a*, a locking portion 7*b*, an introducing portion 7*c*, a shaft 7*d* and the like. The introducing portion 7*c* is constituted as a moving portion for moving, to the operating position shown in (a) and (c) of FIG. 9, the locking member 7 located at the non-operating position shown in (b) of FIG. 9 with the mounting operation of the developer supply container 1. The introducing portion 7*c* is constituted so that at least a free end portion thereof protrudes from the outer peripheral surface of the container body 1*a*.

The locking member 7 changes the rotational load (braking torque) of the gear 5 relative to the container body 1*a*. That is, the locking member 7 also functions as a changing means for changing a suppressing force for suppressing the relative rotation between the developer supply container 1, and the gear 5 and the planetary gear 6 which constitute the drive transmitting means.

In this embodiment, a constitution in which the gear 5 and the planetary gear 6 are capable of rotating relative to the container body 1*a* even when the locking portion 7*b* of the locking member 7 is in a locking state in which the rotation of the fixing member 9 is suppressed by contact of the locking portion 7*b* with the catching portion 9*a* of the fixing member 9 will be described.

In such a constitution, in this embodiment, the above locking member will be referred to as the member 7. The locking member 7 may also be constituted so as to completely prevent the rotation of the gear 5 and the planetary gear 6 relative to the container body 1*a*. In this embodiment, these locking members are collectively referred to as the locking member 7.

Using (a) to (c) of FIG. 9, a relationship between the locking member 7 and the gear 5 will be described. As shown in (a) of FIG. 9, in a state in which the locking portion 7*b* of the locking member 7 is contacted to and caught by the catching portion 9*a* of the fixing member 9 (at the operating position of the locking member 7), the fixing member 9 provided on the gear 5 is prevented from rotating relative to the container body 1*a*.

As shown in (a) of FIG. 9, in the state in which the locking member 7 is in the operating position, the rotational driving force is inputted into the gear 5 from the driving gear 12 through the planetary gear 6. Then, the ring member 14 shown in (a) of FIG. 7 is in a compressed state between the inner circumferential surface 9*b* of the fixing member 9 and a wall surface of the recessed portion 5*b* provided on the outer peripheral surface 5*c* provided as a part of the shaft portion 5*d* of the gear 5. For this reason, the rotational load (braking torque) becomes large.

On the other hand, as shown in (a) of FIG. 9, in a state in which the locking portion 7*b* of the locking member 7 is spaced from and is not caught by the catching portion 9*a* of the fixing member 9 (at the non-operating position of the locking member 7) the fixing member 9 is not prevented from rotating relative to the container body 1*a*.

As shown in (b) of FIG. 9, in the state in which the locking member 7 is in the non-operating position, the rotational driving force is inputted into the gear 5 from the driving gear 12 through the planetary gear 6. Then, the fixing member 9 rotates integrally with the gear 5. That is, the amount by which the rotational load (braking torque) of the gear 5 is increased by the fixing member 9 and the ring member 14 is cancelled, and the rotational load (braking torque) of the gear 5 becomes sufficiently small. In this embodiment, the ring member 14 is sandwiched between the gear 5 and the fixing member 9. As a result, a sliding resistance is generated, so that the rotational load (braking torque) is generated. A constitution in which the rotational load (braking torque) of the gear 5 is generated by another method may also be employed. For example, a constitution in which the rotational load (braking torque) of the gear 5 is generated using magnetic attraction (magnetic force) between S and N poles of a magnet or a constitution in which the rotational load (braking torque) of the gear 5 is generated using the changes in the internal and external diameters (dimensions) due to torsion of an elastic spring may also be employed.

As shown in (c) and (e) of FIG. 6, the locking member 7 in this embodiment employs a flip-flop mechanism switchable to two attitudes corresponding to the operating position shown in (a) and (c) of FIG. 9 and the non-operating position shown in (b) of FIG. 9. A spring member 8 as an urging member for imparting an urging force to the locking member 7 is provided.

The flip-flop mechanism including the spring mechanism refers to the following mechanism in the case where there is a member Z rotatable between, e.g., point X and point Y (distance (angle) L).

That is, the mechanism is such that although the member Z positioned at the point X rotates only by a distance (angle) shorter than the distance L by the action of a member W, rotation of the member Z with respect to a remaining distance (angle) is supplemented by the urging force of the spring member.

As a result, the member Z rotates to the point Y. That is, in the case where there is no spring member 8, the member Z positioned at the point X is subjected to the action to the extent that the position of the member Z cannot reach the point Y.

The flip-flop mechanism for the locking member 7 in this embodiment will be described using FIGS. 6, 7, 9 and 13. As shown in (c) and (e) of FIG. 6, the spring member 8 is locked at one end portion thereof by a shaft in protruding at one end portion of the container body 1*a* with respect to the longitudinal direction. The spring member 8 is locked at the other end portion thereof by a shaft 7*d* protruding from the locking member 7.

As shown in (e) of FIG. 6, the locking member 7 rotates about a shaft 1*h*, so that the spring member 8 is at a rotation phase positioned in a region G shown in (e) of FIG. 6. Then, by a pulling force (urging force) of the spring member 8, the locking member 7 rotates about the shaft 1*h* in an arrow H direction.

The region G shown in (e) of FIG. 6 can be appropriately set depending on a position of the shaft 1*h*, strength of a spring force of the spring member 8, a sliding property between the locking member 7 and the shaft 1*h* for rotatably supporting the locking member 7, and the like.

Figure 13:
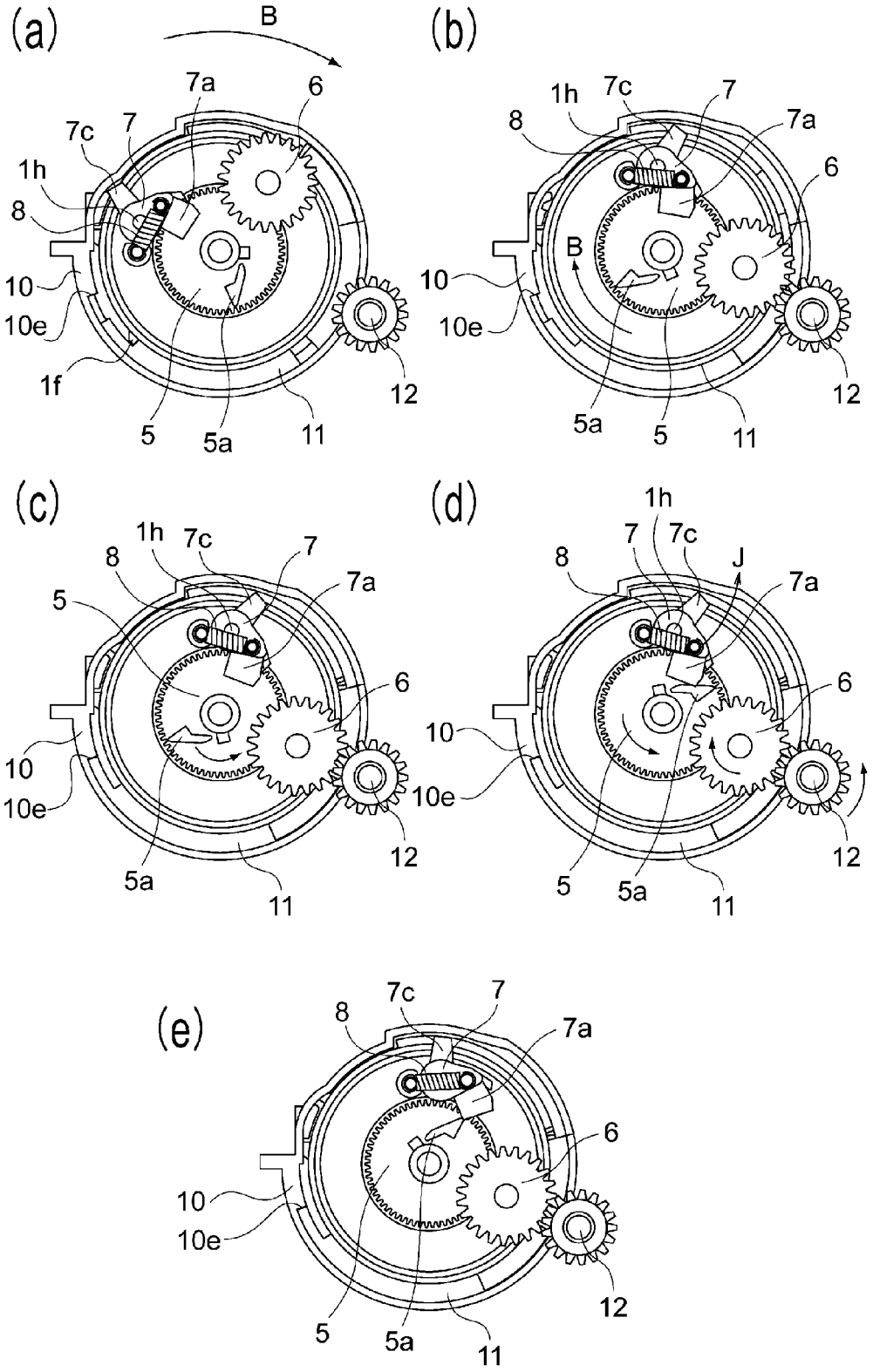
In FIG. 13, (a) is a side illustration showing a state after the developer supply container is inserted and mounted in the developer receiving apparatus, (b) is a side illustration showing a state in which the developer supply container is rotated in the circumferential direction to connect with the drive transmitting means after the developer supply container is inserted and mounted in the developer receiving apparatus, (c) is a side illustration showing a state in which the rotation of the developer supply container is completed after the developer supply container is inserted and mounted in the developer receiving apparatus, (d) is a side illustration showing a state immediately before the suppressing means is moved to the non-operating position by the drive transmitting means, and (e) is a side illustration showing a state in which the suppressing means is moved to the non-operating position by the drive transmitting means.

On the other hand, as shown in (c) of FIG. 6, (a) and (b) of FIG. 7 and (a) to (e) of FIG. 13, at a flat surface portion of the gear 5, a releasing projection 5*a* as a releasing portion is provided in a projected state. The releasing projection 5*a* is, as shown in (a) to (e) of FIG. 13, rotated together with the gear 5 in the counterclockwise direction relative to the developer supply container 1 rotates to the operative position (replenishment position).

As a result, as shown in (d) of FIG. 13, the releasing projection 5*a* provided on the flat surface portion of the gear 5 contacts the portion-to-be-released 7*a* provided on the locking member 7.

Further, the gear 5 rotates in the counterclockwise direction in (d) of FIG. 13. As a result, as shown in (e) of FIG. 13, against the pulling force of the spring member 8, the releasing projection 5*a* provided on the flat surface portion of the gear 5 urges the portion-to-be-released 7*a* provided on the locking member 7. Then, the locking member 7 rotates about the shaft 1*h* in an arrow J direction in (d) of FIG. 13.

That is, the releasing projection 5*a* provided on the flat surface portion of the gear 5 pushes and rotates the portion-to-be-released 7*a* provided on the locking member 7 about the shaft 1*h* in the arrow J direction in (d) of FIG. 13 with rotation of the gear 5 in the counterclockwise direction in (a) to (e) of FIG. 13.

As a result, as shown in (b) of FIG. 9, hooking (engagement) between the locking portion 7*b* of the locking member 7 and the catching portion 9*a* of the fixing member 9 is released (eliminated). Thus, a state in which the braking torque is applied to the gear 5 by the fixing member 9 and the ring member 14 is eliminated.

That is, the drive transmitting means is released from the state in which the rotation of the gear 5 and the planetary gear 6 which constitute the drive transmitting means relative to the developer supply container 1. In other words, a state in which the rotational load (braking torque) of the drive transmitting means (including the gear 5 and the planetary gear 6) relative to the developer supply container 1 is made sufficiently small is creased.

In this embodiment, the rotation of the gear 5 relative to the container body 1*a* is not completely prevented (locked). In a state in which the developer supply container 1 is stopped at the operative position (replenishment position), the rotational load (braking torque) is applied to the extent that the gear 5 can rotate relative to the container body 1*a*.

In this embodiment, the locking member 7 and the introducing portion 7*c* were provided integrally with each other. Another constitution in which the introducing portion 7 is provided as a separate member from the locking member 7 and the introducing portion 7*c* as the separate member transmits the rotational driving force from the driving gear 12 of the developer receiving apparatus 10 to the locking member 7 may also be employed.

<Setting Operation after Mounting of Developer Supply Container>

A setting operation after the developer supply container 1 is mounted in the developer receiving apparatus 10 will be described using FIGS. 4-7, FIGS. 9-13 and FIG. 15. In FIG. 11, (a) is a perspective illustration, of the developer supply container 1, showing a state in which the developer receiving opening 10*a* is closed by the shutter 11. In FIG. 12, (a) is a perspective illustration, of the developer supply container 1, showing a state in which the developer receiving opening 10*a* is opened by the shutter 11.

Further, (b) of FIG. 11 and (b) of FIG. 12 are sectional views showing a positional relationship between the developer discharge opening 1*b* and the developer receiving opening 10*b* in states shown in (a) of FIG. 11 and (a) of FIG. 12, respectively. Further, (c) of FIG. 11 and (c) of FIG. 12 are sectional views showing a positional relationship among the driving gear 12, the gear 5 and the planetary gear 6 in states shown in (a) of FIG. 11 and (b) of FIG. 12, respectively. Further, (d) of FIG. 11 and (d) of FIG. 12 are sectional views showing a positional relationship between the shutter 11 and the container body 1*a* in states shown in (a) of FIG. 11 and (a) of FIG. 12, respectively.

In FIG. 15, (a) is a sectional illustration showing a structure in the neighborhood of the handle 2 after the developer supply container 1 is mounted in the developer receiving apparatus 10. In FIG. 15, (b) is a sectional illustration showing a structure in the neighborhood of the handle 2 when the developer supply container 1 is being demounted from the developer receiving apparatus 10.

The setting operation after the mounting of the developer supply container 1 is as follows. From the mounting position where the developer supply container 1 is mounted in the developer receiving apparatus 10, the developer supply container 1 is rotated in the circumferential direction through a predetermined angle. That is, the setting operation is a rotating operation of the developer supply container 1 in the circumferential direction toward the operative position (replenishment position) where a developer supplying (replenishing) operation of the developer supply container 1 can be performed.

A mounting and demounting position is a position for permitting mounting and demounting of the developer supply container 1 relative to the developer receiving apparatus 10. Further, the operative position (replenishment position) capable of the developer supplying operation of the developer supply container 1 is a supply position (set position) where the developer can be supplied (discharged) from the developer supply container 1 to the developing device 201*a* provided in the main assembly of the image forming apparatus 100.

After the time when the developer supply container 1 is slightly rotated in the circumferential direction from the mounting and demounting P for permitting the mounting and demounting thereof relative to the developer receiving apparatus 10, the developer supply container 1 is in a state in which the mounting and demounting thereof relative to the developer receiving apparatus 10 is prohibited by the locking mechanism. Further, also at the operative position (replenishment position) capable of the developer supplying operation of the developer supply container 1, the developer supply container 1 is in the state in which the mounting and demounting thereof relative to the developer receiving apparatus 10 is prohibited.

The setting operation after the mounting of the developer supply container 1 will be described. First, as shown in FIG. 10, the user opens the openable cover 15. As a result, the developer supply container 1 is inserted into the developer receiving apparatus 10 in the arrow A direction in FIG. 10 through an opening formed in the main assembly of the image forming apparatus 100.

At this time, as shown in (c) of FIG. 11, the driving gear 12 provided on the developer receiving apparatus 10 and the planetary gear 6 provided in the developer supply container 1 are spaced from each other in the circumferential direction of the developer supply container 1. As a result, the drive transmission from the driving gear 12 to the planetary gear 6 becomes impossible.

Further, at that time, as shown in (a) of FIG. 15, the wiping member 18 provided on the inner peripheral surface of the developer receiving apparatus 10 and the recessed portion 19 provided on the outer peripheral surface of the developer supply container 1 are opposed to each other in a non-sliding (friction) state.

Then, as shown in (a) of FIG. 11 and (a) of FIG. 15, the developer supply container 1 is inserted and mounted in the developer receiving apparatus 10. Thereafter, the user grips and rotates the handle 2 to a position shown in (a) to (d) of FIG. 12 in the arrow B direction (opposite to the rotational direction of the discharging member 4) shown in (b) to (d) of FIG. 11. As a result, the drive-connection between the developer supply container and the developer receiving apparatus 10 is made.

Specifically, the container body 1*a* rotates in the arrow B direction in (c) of FIG. 11. Then, as shown in (c) of FIG. 12, the planetary gear 6 rotatably provided at one longitudinal end surface of the container body 1*a* revolves about, as the revolving shaft, the rotation center (rotation center of the stirring shaft 4*a* of the discharging member 4) R of the container body 1*a*, and engages with the driving gear 12 provided on the developer receiving apparatus 10. Thus, a state in which the rotational driving force is transmittable from the driving gear 12 to the planetary gear 6 is created.

In FIG. 13, (a) shows a state in which the user inserts and mounts the developer supply container 1 in the developer receiving apparatus 10, and (b) shows a state in which the user grips and rotates the handle 2 of the developer supply container 1 from the state of (a) of FIG. 13 in the circumferential direction shown as the arrow B direction in (b) of FIG. 13.

In the state shown in (b) of FIG. 13, as shown in (b) of FIG. 11, the developer discharge opening 1*b* of the developer supply container 1 is closed by the shutter 3. At this time, the leading edge of developer discharge opening 1*b* provided in the cylindrical surface of the container body 1*a* along the longitudinal direction of the container body 1*a* is in an opposing position to a stopper portion 10*d* of the shutter 11 provided on the developer receiving apparatus 10 shown in (a) of FIG. 5. As shown in (b) of FIG. 11, also the developer receiving opening 10*b* is in a completely closed state by the shutter 11, so that the developer cannot be supplied.

Then, the user closes the contactable cover 15 shown in FIG. 10. When the openable cover 15 is closed, the closing of the openable cover 15 is detected by a sensor 21 shown in FIG. 4, and on the basis of a detection result thereof, a CPU 20 rotationally drives the motor 13.

The rotational driving force of the motor 13 is transmitted to the driving gear 12 rotatably shaft-supported by the developer receiving apparatus 10 via an unshown gear train. Thus, the rotational driving force of the motor 13 is inputted in the driving gear 12. Then, as shown in (b) of FIG. 13, the rotational load (braking torque) of the planetary gear 6 engaging with the driving gear 12 is constituted as follows. The rotational load is made large by the action of a torque generating mechanism constituted by the fixing member 9 and the ring member 14 which are provided on the gear 5 and which are shown in (a) and (b) of FIG. 7 and by the locking member 7 shown in (a) to (c) of FIG. 9.

As a result, the rotational driving force of the driving gear 12 acts in the revolving direction in which the planetary gear 6 revolves about, as the revolving axis, the rotation center of the container body 1*a*, so that the developer supply container 1 automatically rotates toward the operative position (replenishment position) by the rotational driving force of the driving gear 12.

In this embodiment, incidentally, as shown in FIG. 14, a rotational force f which is generated in the developer supply container 1 using the gear 5 and the planetary gear 6 which constitute the drive transmitting means is set to be greater than reaction F which is received by the developer supply container 1 from the developer receiving apparatus 10. Therefore, the developer supply container 1 can automatically and properly rotate.

At this time, the operation for rotating the developer supply container 1 and the operation for opening the shutter 11 are carried out in interrelation with each other by the unsealing projection 1*e* shown in (a) of FIG. 6 and (d) of FIG. 12. Specifically, by the rotation of the container body 1*a*, the unsealing projection 1*e* is moved from the state shown in (d) of FIG. 11 to the position shown in (d) of FIG. 12. Then, the shutter 11 is pushed down from the state shown in (b) of FIG. 11 by the unsealing projection 1*e* being thereby slid and moved to the position shown in (b) of FIG. 12, so that the developer receiving opening 10*b* is unsealed (opened).

On the other hand, in interrelation with the unsealing operation of the shutter 11 with the rotation of the container body 1*a*, the shutter 3 abuts against an unshown locking portion provided on the developer receiving apparatus 10. Thus, the rotation of the shutter 3 is prevented (limited), so that the developer discharge opening 1*b* is unsealed (opened).

As a result, with the rotation of the container body 1*a*, as shown in (b) of FIG. 12, the developer discharge opening 1*b* become exposed from the shutter 3 and the developer receiving opening 10*b* exposed from the shutter 11 are opposed to and communicated with each other.

As shown in (b) of FIG. 12 and (c) of FIG. 13, the shutter 11 stops as it abuts against the stopper portion 10*e* for defining an end position of unsealing movement of the shutter 11. Therefore, a lower edge 10*b*1 of the developer receiving opening 10*b* and an upper edge 11*a* of the shutter 11 are aligned with each other with reliability. Incidentally, the automatic rotation of the developer supply container 1 ends in interrelation with the stop of the movement of the shutter 11 which is in connection with the developer supply container 1.

Incidentally, in this embodiment, as shown in (b) of FIG. 12, the developer supply container 1 is located at the operation position (replenishment position). At that time, in order to ensure that the position of the developer discharge opening 1*b* becomes precisely aligned with the position of the developer receiving opening 10*b*, the position of the developer discharge opening 1*b* with respect to the circumferential direction is adjusted.

As shown in (a) and (b) of FIG. 15, the recessed portion 19 provided on the outer peripheral surface of the container body 1*a* of the developer supply container 1 is disposed over a full circumference of the container body 1*a*. As a result, the recessed portion 19 and the wiping member 18 provided on the outer peripheral surface of the developer receiving apparatus 10 are positioned and kept in the state shown in (a) of FIG. 15, i.e., in a non-sliding (friction) state during the automatic rotation of the developer supply container 1. As a result, an increase in rotational resistance of the developer supply container 1 during the automatic rotation due to the sliding between the wiping member 18 and the developer supply container 1 is prevented.

The input of the rotational driving force into the driving gear 12 is continuously performed. At this time, as shown in (b) of FIG. 12, the developer supply container located at the operative position (replenishment position) is in a contacted state with the stopper portion 10*e* provided in the developer receiving apparatus 10, i.e., in a state in which further rotation of the developer supply container 1 is prevented via the shutter 11.

Then, relative to the rotation-prevented shutter 11, the gear 5 starts the following rotation. The gear 5 starts rotation in the counterclockwise direction in (c) of FIG. 13 relative to the developer supply container 1 against the braking torque by the torque generating mechanism constituted by the fixing member 9 and the ring member 14 which are shown in (a) and (b) of FIG. 7 and the locking member 7 shown in (a) to (c) of FIG. 9. Then, as shown in (d) of FIG. 13, the releasing projection 5*a* provided on the flat surface portion of the gear 5 abuts against the portion-to-be-released 7*a* of the locking member 7.

When the gear 5 further rotates in the counterclockwise direction in (d) of FIG. 13, the releasing projection 5*a* pushes up the portion-to-be-released 7*a* of the locking member 7 in the arrow J direction in (d) of FIG. 13 against the pulling force (tensile force) of the spring member 8. As a result, as shown in (e) of FIG. 13, the locking member 7 rotates about the shaft 1*h* in the counterclockwise direction in (e) of FIG. 13, so that as shown in (b) of FIG. 9, the locking portion 7*b* of the member 7 is spaced from the catching (hooking) portion 9*a* of the fixing member 9 to be disengaged from the catching portion 9*a*. As a result, the rotational load (braking torque) imparted to the gear 5 by the fixing member 9 and the ring member 14 which are shown in (a) of FIG. 7 is released (eliminated).

In a developer supplying step after the rotational load (braking torque) imparted to the gear 5 by the fixing member 9 and the ring member 14, the force required to rotate the planetary gear 6 and the gear 5 which constitute the drive transmitting means by the driving gear 12 provided on the developer receiving apparatus 10 is small. Therefore, the driving gear 12 is not subjected to a large amount of rotational load, so that stable drive transmission can be carried out.

In this embodiment, as shown in (b) of FIG. 12, automatic rotation of the developer supply container 1 for aligning the position of the developer discharge opening 1*b* and the position of the developer receiving opening 10*b* with each other is ended. Thereafter a predetermined time difference is provided, so that the rotational lead borne (braking torque) imparted to the gear 5 by the fixing member 9 and the ring member 14 shown in (a) of FIG. 7 is removed. As a result, it is possible to satisfactorily perform positional alignment between the developer discharge opening 1*b* and the developer receiving opening 10*b*.

Incidentally, the rotational load (braking torque) applied to the planetary gear 6 and the gear 5 which constitute the drive transmitting means is not changed but is maintained as it is. In such a constitution, the following problems generates. Therefore, the constitution in this embodiment in which the rotational load (braking torque) applied to the planetary gear 6 and the gear 5 is changed is preferable.

That is, in the constitution in which the rotational load (braking torque) applied to the planetary gear 6 and the gear 5 is kept as it is without being changed, the gear 5 remains under the action of the suppression means, constituted by the fixing member 9 and the ring member 14 which are provided on the gear 5 shown in (a) of FIG. 7, for a long time even after the position of the developer discharge opening 1*b* aligns with the position of the developer receiving opening 10*b* and the rotation of the developer supply container 1 ends.

Therefore, the rotational load (braking torque) always applied to the driving gear 12 through the planetary gear 6. As a result, there is a liability that the rotational load has the influence on the durability of the driving gear 12 and stability of driving force transmission, etc. Further, there is a liability that the ring 14 generates heat by the rotational friction for a long time, and this heat cause thermal deterioration of the gear 5 or the like constituting the drive transmitting means, and the thermal deterioration of the developer in the developer supply container 1.

On the other hand, in this embodiment, the rotational load (braking torque) applied to the gear 5 after the positional alignment of the developer discharge opening 1*b* with the developer receiving opening 10*b* is released. As a result, it is possible to reduce the amount of the electric power which is required to drive the planetary gear 6 and the gear 5 which constitute the drive transmitting means by the driving gear 12 provided on the developer receiving apparatus 10.

Further, it is unnecessary to excessively increase strength and durability of the gear train such as the driving gear 12 in the developer receiving apparatus 10 side. As a result, this embodiment can contribute to the cost reduction of the developer receiving apparatus 10. Further, it is possible to prevent the drive transmitting means, such as the gear 5, and the developer from being thermally deteriorated.

In this embodiment, a simple constitution in which the rotational driving force is inputted into the planetary gear 6 and the gear 5 which constitute the drive transmitting means provided in the developer supply container 1 from the driving gear 12 provided on the developer receiving apparatus 10 is employed. Thus, automation of an operation for positioning the developer supply container 1 to properly carry out the developer supplying operation after the mount of the developer supply container 1 in the developer receiving apparatus 10.

That is, there is no need to provide an exclusive motor and a gear train or the like in another system for rotating the developer supply container 1. Thus, the developer supply container 1 can be automatically rotated to its operative position (replenishment position) with the use of the simple constitution using the planetary gear 6 and the gear 5 which constitute the driving transmitting means for rotating the discharging member 4 in the container body 1*a*.

As a result, only it becomes possible to improve usability but also the developer supplying operation can be satisfactorily performed. Therefore, it is possible to suppress generation of defective images, such as non-uniformity in image density and insufficient image density, which are attributable to the insufficiency in supply amount of the developer.

In this embodiment, using the planetary gear 6 and the gear 5 which constitute the drive transmitting means for rotating the discharging member 4 in the container body 1*a*, it becomes possible to suppress a problem which is concerned in the case where the developer supply container 1 is automatically rotated to the operative position (replenishment position).

<Demounting Operation of Developer Supply Container>

Using FIG. 6, FIGS. 10 and 12 and FIG. 15, a demounting operation when the developer supply container 1 is demounted from the developer receiving apparatus 10 for some reason such as exchange or the like of the developer supply container 1 will be described. First, the user opens the openable cover 15 of the main assembly of the image forming apparatus 100 shown in FIG. 10.

Then, the user grips the handle 2 of the developer supply container 1 exposed through the opening which is opened and then rotates the handle in an opposite direction to the arrow B direction in (b) to (d) of FIG. 11. As a result, the developer supply container 1 is rotated from the operative position (replenishment position) to the mounting and demounting P. That is, the developer supply container 1 is returned to the mounting and demounting P and thus is in the state shown in (c) of FIG. 11 and (a) of FIG. 15.

At this time, with rotation of the developer supply container 1 from the state shown in (b) of FIG. 12 in the opposite direction to the arrow B direction in (b) of FIG. 11, the sealing projection if provided on the outer peripheral surface of the container body 1*a* shown in (c) of FIG. 6 and (b) of FIG. 11 rotates.

Then, as shown in (b) of FIG. 11, the shutter 11 is pushed up by the sealing projection 1*f*, so that the developer receiving opening 10*b* is closed by the shutter 11. Then, with rotation of the developer supply container 1 in the opposite direction to the arrow B direction in (b) of FIG. 11, also the developer discharge opening 1*b* provided in the outer peripheral surface of the container body 1*a* is rotated in the opposite direction to the arrow B direction in (b) of FIG. 11 and thus is closed by the shutter 3.

Specifically, the shutter 3 shown in (a) of FIG. 11 abuts against an unshown stopper portion provided in the developer receiving apparatus 10, so that further movement thereof is prevented. In this state, by rotation of the developer supply container 1, the developer discharge opening 1*b* provided in the outer peripheral surface of the container body 1*a* is closed again by the shutter 3.

The rotation of the developer supply container 1 for closing the shutter 11 again is stopped by abutment of the shutter 3 against the unshown stopper portion provided on the guide portion 1*d* for the shutter 3 shown in (a) of FIG. 3.

The planetary gear 6 rotatably provided on the one longitudinal end surface of the container body 1*a* and the driving gear 12 rotatably provided on the developer receiving apparatus 12 are spaced from each other while following the rotation of the developer supply container 1 in the opposite direction to the arrow B direction in (c) of FIG. 11, so that engagement between the planetary gear 6 and the driving gear 12 is eliminated.

As a result, at the time when the developer supply container 1 is in the mounting and demounting P, the planetary gear 6 and the driving gear 12 are in a state in which these gears do not interfere with each other. Finally, the user takes out the developer supply container 1 located at the mounting and demounting position from the developer receiving apparatus 10.

By repetition of the setting operation after the mounting of the developer supply container 1, the developer scattered through the developer discharge opening 1*b* of the developer supply container 1 and the developer receiving opening 10*b* of the developer receiving apparatus 10 is accumulated in the developer receiving apparatus 10. As a result, when a new developer supply container 1 is mounted, the developer is transferred onto the outer peripheral surface of the developer supply container 1, so that the outer peripheral surface of the developer supply container 1 is contaminated with the developer in some cases.

In some cases, the scattered developer is accumulated in the developer receiving apparatus 10 and is then transferred onto the outer peripheral surface of the developer supply container 1. In this embodiment, as shown in (b) of FIG. 15, the developer deposited on the outer peripheral surface of the developer supply container 1 is wiped off by the wiping member 18 provided on the inner peripheral surface of the developer receiving apparatus 10, and then the developer supply container 1 is taken out in a cleaned state. For this reason, when the user touches the developer supply container 1 which is taken out, a hand of the user is not contaminated with the developer.

As shown in (a) and (b) of FIG. 15, the recessed portion 19 is provided in the neighborhood of the handle 2 side (right side in (a) and (b) of FIG. 15) with respect to the longitudinal direction (left-right direction in (a) and (b) of FIG. 15) of the container body 1*a*. In the developer supply container 1, the recessed portion 19 is provided in the neighborhood of an upstream side of the mounting direction of the developer supply container 1 shown as the arrow A direction in (a) of FIG. 6.

As a result, the wiping member 18 can be provided in the neighborhood of a mounting opening (entrance) of the developer supply container 1 in the developer receiving apparatus 10. Through the mounting opening, the developer supply container 1 is demounted from the developer receiving apparatus 10. At that time, by the wiping member 18 provided on the inner peripheral surface of the developer receiving apparatus 10, the outer peripheral surface of the developer supply container 1 can be cleaned over an entire region of the developer supply container 1 with respect to the longitudinal direction (left-right direction in (a) and (b) in FIG. 15).

As shown in FIG. 4, the wiping member 18 is provided in a lower side in FIG. 4 than the rotation center R (stirring shaft 4*a*) of the developer supply container 1 with respect to the circumferential direction. This is because the developer scattered inside the developer receiving apparatus 10 is liable to be accumulated in the lower side of the inner peripheral surface of the developer receiving apparatus 10 by gravitation. As a result, it is possible to reliably remove the developer transferred from the developer receiving apparatus 10 to the lower portion of the outer peripheral surface of the developer supply container 1.

After the developer supply container 1 which is used up is demounted from the developer receiving apparatus 10, the user replaces the developer supply container 1 with the new developer supply container 1 prepared in advance. The mounting and demounting operation or the like of the developer supply container 1 is similar to the mounting and demounting operation and the subsequent setting operation of the developer supply container 1 which are described above.

<Principle of Automatic Rotation of Developer Supply Container>

A principle of the automatic rotation of the developer supply container 1 after the user mounts the developer supply container 1 in the developer receiving apparatus 10 will be described using FIG. 14. FIG. 14 is a schematic view for illustrating the principle of the automatic rotation of the developer supply container 1 by the pulling force generated by the action of the torque generating mechanism constituted by the fixing member 9 and the ring member 14 which are provided on the gear 5 shown in (a) of FIG. 7 and the locking member 7 shown in (a) to (c) of FIG. 9.

As shown in FIG. 14, the planetary gear 6 rotatably provided on the one longitudinal end surface of the container body 1*a* of the developer supply container 1 engages with the driving gear 12 provided rotatably on the developer receiving apparatus 10. In that state, the planetary gear 6 receives the rotational driving force from the driving gear 12 in an arrow M1 direction in FIG. 14. At that time, the rotation center P of the shaft portion P of the planetary gear 6 is subjected to a rotational force f with rotation of the planetary gear 6, so that the rotational force f acts on the container body 1*a*.

At this time, the rotational force f is greater than reaction F (reaction which the outer peripheral surface of the developer supply container 1 receives from the inner peripheral surface of the developer receiving apparatus 10 due to sliding resistance therebetween) which the developer supply container 1 receives from the developer receiving apparatus 10. In that case, the container body 1*a* rotates about the rotation center R in the counterclockwise direction in FIG. 14.

Therefore, the torque generating mechanism constituted by the fixing member 9 and the ring member 14 shown in (a) of FIG. 7 and the locking member 7 shown in (a) to (c) of FIG. 9 is caused to act on the gear 5. The rotational load (braking torque) exerted from the planetary gear 6 on the developer supply container 1 by the action thereof may preferably be made larger than the response F which the developer supply container 1 receives from the developer receiving apparatus 10.

On the other hand, it is desired that after the action of the torque generating mechanism constituted by the fixing member 9 and the ring member 14 shown in (a) of FIG. 7 and the locking member 7 shown (a) to (c) of FIG. 9 is eliminated, the rotation load (braking torque) of the planetary gear 6 relative to the developer supply container 1 may preferably be made smaller than the reaction F which the developer supply container 1 receives from the developer receiving apparatus 10.

A relationship in magnitude between the rotational force f acting from the driving gear 12 on the container body 1*a* via the planetary gear 6 and the reaction F which the outer peripheral surface of the developer supply container 1 receives from the inner peripheral surface of the developer receiving apparatus 10 due to the sliding resistance therebetween is as follows. The relationship may desirably be satisfied in a period from the start of engagement between the driving gear 12 and the planetary gear 6 until as shown in (b) of FIG. 12, the unsealing (opening) operation of the developer receiving opening 10*b* by movement of the shutter 11 is completed.

The rotational force f shown in FIG. 14 can be obtaining by measuring the rotational torque when the driving gear 12 in the engaged state with the planetary gear 6 is manually rotated in the direction of unsealing (opening) the developer receiving opening 10*b* by movement of the shutter 11 as shown in (b) of FIG. 12.

Specifically, a shaft for measurement which rotates together with the driving gear 12 is provided at the rotation center Q of the rotation shaft 12*g* of the driving gear 12. The rotational torque of the shaft for measurement can be obtained by being measured using an unshown torque measuring device. At this time, the torque is measured in a state in which there is no developer (toner) in the container body 1*a*.

The reaction F shown in FIG. 14 can be obtained by measuring the rotational torque about the rotation center R of the container body 1*a* when the container body 1*a* is manually rotated in the unsealing (opening) direction of the shutter 3 of the developer receiving apparatus 10 as shown in (b) of FIG. 12.

This measurement is carried out by rotating the container body 1*a* in a period from the start of engagement of the planetary gear 6 and the driving gear 12 until the unsealing of the developer receiving opening 10*b* by the movement of the shutter 11 is completed.

Specifically, the driving gear 12 is demounted from the developer receiving apparatus 10, and a shaft for measurement which rotating together with the container body 1*a* is provided at the rotation center R of the container body 1*a*. The rotational torque of the shaft for measurement can be obtained by being measured using an unshown torque measuring device.

In this embodiment, as the torque measuring device used for each of the measurements described above, a torque gauge (trade name: BTG90CN) made by Tohnichi Mfg. Co., Ltd. was used. Incidentally, the rotational torque may also be automatically measured using, as the torque measuring device, a torque measuring device in which a rotational motor and a torque converting device are mounted.

Next, referring to FIG. 14, the principle of the automatic rotation of the developer supply container 1 after the user mounts the developer supply container 1 in the developer receiving apparatus 10 will be described. In FIG. 14, the radii of the pitch circles of the driving gear 12, the planetary gear 6, and the gear 5 are a, b and c, respectively.

Further, the rotational torques generating on the rotation center Q, P and R of the driving gear 12, the planetary gear 6, and the gear 5, respectively, are $I_Q$, $T_P$ and $T_R$, respectively. A force (pulling force) for revolving the planetary gear 6 about the rotation center R of the gear 5 as the revolving axis in the counterclockwise direction in FIG. 14 after the planetary gear 6 and the driving gear 12 engage with each other is E. Further, a resistance torque generating on the rotation center R of the container body 1*a* is D.

In FIG. 14, a condition for rotating the container body 1*a* in the clockwise direction is represented by the following formula 1 using the reaction F and the rotational force f shown in FIG. 14.

$$f>F \qquad \text{formula 1}$$

The reaction F and the rotational force f shown in FIG. 14 are as follows. The reaction F is represented by the following formula 2 using the resistance torque D generating on the rotation center R of the container body 1*a*, and the radii b and c of the pitch circles of the planetary gear 6 and the gear 5. The rotational force f is represented by the following formula 2 using the force E for revolving the planetary gear 6, and the rotational torques $T_P$ and $T_R$ generating on the rotation centers P and R of the planetary gear 6 and the gear 5, respectively.

$$F=D/(b+c)$$

$$f=(c+2b)/(c+b)\times E=(c+2b)/(c+b)\times(T_R/c+T_P/b) \quad \text{formula 2}$$

Using the formulas 1 and 2, the condition for rotating the container body 1*a* in the clockwise direction in FIG. 14 is the case where a relationship represented by the following formula 3 is satisfied.

$$(c+2b)/(c+b)\times(T_R/c+T_P/b)/(b+c)(T_R/c+T_P/b)>D/(c+2b) \quad \text{formula 3}$$

The force (pulling force) E for revolving the planetary gear 6 with reliability is generated by the torque generating mechanism constituted by the fixing member 9 and the ring member 14 which are provided on the gear 5 and which are shown in (a) of FIG. 7 and by the locking member 7 shown in (a) to (c) of FIG. 9. As a result, in order to rotate the container body 1*a* in the clockwise direction in FIG. 14, there is a need to satisfy the above-described formula 3.

For this reason, at least one of the rotational torques $T_P$ and $T_R$ generating on the rotation centers P and R of the planetary gear 6 and the gear 5, respectively, is increased. Alternatively, it would be considered that the resistance torque D generating on the rotation center R of the container body 1*a* is made small.

That is, when the rotational torque $T_R$ of the gear 5 connected with the stirring shaft 4*a* of the discharging member 4 provided in the container body 1*a* and the rotational torque $T_P$ of the planetary gear 6 are increased and the reaction F of the container body 1*a* is decreased, the container body 1 can be rotated in the clockwise direction in FIG. 14.

In this embodiment, the rotational torque $T_R$ of the gear 5 is increased by the torque generating mechanism constituted by the fixing member 9 and the ring member 14 which are provided on the gear 5 and which is shown in (a) of FIG. 7 and the locking member 7 shown in (a) to (c) of FIG. 9. Consequently, the increase in $T_R$ is achieved by increasing the rotational torque $T_P$ always engaging with the gear 5.

When the rotation of the container body 1*a*, on which the planetary gear 6 is rotatably shaft-supported, about the rotation center R in the clockwise direction in FIG. 14 by generating the force (pulling force) E for revolving the planetary gear 6 with reliability is taken into consideration, the rotational torque $T_R$ of the gear 5 is preferable as it is larger.

However, when the rotational torque $T_R$ of the gear 5 is excessively large, an amount of electric power consumption of the motor 13 for rotationally driving the driving gear 12 provided on the developer receiving apparatus 10 becomes large. Or, strength and durability of each of the gear 5, the planetary gear 6, the driving gear 12 and the gear train provided between the driving gear 12 and the motor 13 are required to be excessively increased.

Further, the excessively large rotational torque $T_R$ is also unpreferable from the viewpoint of the influence of heat generation of the driving system on the developer. For this reason, the rotational torque $T_R$ of the gear 5 may preferably be set to an optimum value by adjusting a compression amount of the ring member 14 shown in (a) of FIG. 7 relative to the inner peripheral surface 9*b* of the fixing member 9 or the material for the ring member 14.

As for the reaction which the developer supply container 1 receives from the developer receiving apparatus 10 (sliding resistance between the outer peripheral surface of the developer supply container 1 and the inner peripheral surface of the developer receiving apparatus 10F), it is desired to be as small as possible. In this embodiment, from the viewpoints described above, the area of the sliding portion of the container body 1*a* (peripheral surface of the container body 1*a*) during rotation is made small or the sealing member excellent in sliding property is provided on the outer peripheral surface of the container body 1*a*.

Next, the method for setting the rotational torque Tp of the planetary gear 6 will be described.

It is desired that the value of the rotational torque Tp applied to the planetary gear 6 may preferably be set to a proper value in consideration of a magnitude of a rotating force of the container body 1*a* (the rotating force at the outer peripheral surface of the developer supply container 1*f*), a diameter (2×radius d) of the container body 1*a*, and an amount e of eccentricity and a diameter (2×radius b) of the planetary gear 6.

Here, when the reaction of the container body 1*a* is F, the diameter of the container body 1*a* is (2×d), the amount e of eccentricity of the planetary gear 6 (distance from the rotation center R of the container body 1*a* to the rotation center P by which the planetary gear 6 is shutter-supported) is e, and the diameter of the planetary gear 6 is (2×b), the rotational torque $T_P$ of the planetary gear 6 satisfies a relationship represented by the following formula 4.

$$T_P=F\times(2\times b)\times(2\times d)/[2\times\{2e+(2\times b)\}] \quad \text{formula 4}$$

First, the reaction F of the container body 1*a* varies also depending on the diameter (2×d) of the container body 1*a*, and a sealing area, a physical property of the sealing member used and a sealing structure in the case where the sealing member excellent in sliding property is provided on the outer peripheral surface of the container body 1*a*. It would be considered that a general-purpose container body 1*a* is about 30 mm-200 mm in diameter. In that case, the rotational torque $T_P$ of the planetary gear 6 is set in a range of 1 N to 200 N in general.

The diameter (2×b) of the planetary gear 6 is about 4 mm-100 mm in consideration of the diameter (2×d) of the container body 1*a*. The amount e of eccentricity is about 4 mm-100 mm. These numerical values are appropriately selected depending on a size of the image forming apparatus 100 and specifications of the image forming apparatus 100.

In the container body 1*a* generally considered, the rotational torque $T_P$ of the planetary gear 6 is $3.0\times10^{-4}$ N.m-18.5 N.m using a maximum and a minimum in a range considered of each of the above-described numerical values.

For example, the case where the diameter (2×d) of the container body 1*a* as used in this embodiment is 60 mm and the sealing member excellent in sliding property is provided on the outer peripheral surface of the container body 1*a* is assumed. When also a variation in the sealing member or the like is taken into consideration, it would be considered that the reaction T of the container body 1*a* is in the range of about 5 N to 100 N.

In this embodiment, when the amount e of eccentricity of the planetary gear 6 is 20 mm and the diameter (2×b) of the planetary gear 6 is 20 mm, the rotational torque Tp of the gear 6 may preferably be set to about 0.05 N.m to 1 N.m in consideration that the reaction F of the container body 1*a* falls within the range of about 5 N to 100 N.

A lower limit of the rotational torque Tp of the planetary gear 6 may preferably be set to 0.1 N.m which is about twice 0.05 N.m, when various amounts of loss, fluctuations in dimension of members, a safety factor and the like are taken into consideration. An upper limit of the rotational torque Tp of the planetary gear 6 may preferably be about 0.5 N.m in consideration of strength of the torque generating mechanism constituted by the fixing member 9 and the ring member 14 which are provided on the gear 5 and which are shown in (a) of FIG. 7 and the locking member 7 shown in (a) to (c) of FIG. 9. That is, the rotational torque Tp of the planetary gear 6 may preferably be set to about 0.1 N.m to 0.5 N.m.

In this embodiment, the rotational torque Tp of the planetary gear 6 is constituted so as to fall within a range of about 0.15 N.m to 0.34 N.m including the variation in various members and a stirring torque (about 0.05 N.m) generating when the developer in the container body 1*a* is stirred by the discharging member 4.

The stirring torque generating when the developer in the container body 1*a* is stirred by the discharging member 4 varies also depending on the filling amount of the developer and the structure of the discharging member 4, and therefore may be appropriately set.

As shown in FIG. 14, the force (pulling force) E for revolving the planetary gear 6 engaging with the driving gear 12 about, as the revolving axis, the rotation center R of the container body 1*a* acts on the planetary gear 6. Thus, the developer supply container 1 is automatically rotated in the counterclockwise direction in FIG. 14 together with the container body 1*a* by which the planetary gear 6 is rotatably shaft-supported.

Thereafter, as shown in (a) of FIG. 9, the locking member 7 is released, so that the braking torque generated by the torque generating mechanism constituted by the fixing member 9 and the ring member 14 provided on the gear 5 as shown in (a) of FIG. 7 and the member 7 shown in (a) to (c) of FIG. 9 becomes 0 (zero). In that case, the load required to drive the developer supply container 1 is only the stirring torque generating when the developer in the container body 1*a* is stirred by the discharging member 4.

In this embodiment, as shown in (b) of FIG. 9, the rotational torque Tp of the planetary gear 6 after the locking member 7 is released is about 0.05 N.m which is the stirring torque generating when the developer in the container body 1*a* is stirred by the discharging member 4.

As shown in (b) of FIG. 9, the rotational torque Tp of the planetary gear 6 after the locking member 7 is released is as follows. The rotational torque Tp may preferably be smaller when the load exerted on the driving gear 12 provided on the developer receiving apparatus 10 or exerted on the gear train from the driving gear 12 to the motor 13 provided in the main assembly of the image forming apparatus 100 and the electric power consumption of the motor 13 and the like are taken into consideration.

In this embodiment, the braking torque generated by the torque generating mechanism constituted by the fixing member 9 and the ring member 14 provided on the gear 5 as shown in (a) of FIG. 7 and the member 7 shown in (b) of FIG. 9 is as follows. As shown in (b) of FIG. 9, the braking torque is larger than 0.05 N.m in some cases when the locking member 7 is released (eliminated). At that time, heat generates from the fixing member 9 and the ring member 14 which are shown in (a) of FIG. 7 and which constitutes a braking torque generating portion. Then, there is a possibility that the heat is accumulated and conducted to the developer in the developer supply container 1 (container body 1*a*) to have the influence on the developer.

Accordingly, as shown in (b) of FIG. 9, the braking torque generated by the torque generating mechanism constituted by the fixing member 9 and the ring member 14 provided on the gear 5 as shown in (a) of FIG. 7 after the locking member 7 is released and by the locking member 7 may preferably be less than 0.05 N.m.

Further, it is also important to take into consideration the direction in which the force (pulling force) E, generating when the planetary gear 6 receives the rotating force f from the driving gear 12, for revolving the planetary gear 6 about the rotation center R as the revolving axis of the container body 1*a* acts.

Next, the acting direction of the force (pulling force) E, generating when the planetary gear 6 receives the rotating force f from the driving gear 12, for revolving the planetary gear 6 about the rotation center R as the revolving axis of the container body 1*a* will be described.

The rotating force of generating at the rotation center P of the shaft portion 6*a* of the planetary gear 6 in order to rotate the container body 1*a* in the clockwise direction in FIG. 14 corresponds to a component of the force (pulling force) E, received from the driving gear 12 by the planetary gear 6, for revolving the planetary gear 6 about the rotation center R as the revolving axis of the container body 1*a*.

Accordingly, depending on a positional relationship in a state in which the planetary gear 6 and the driving gear 12 are engaged with each other, the case where the rotating force of generating at the rotation center P of the shaft portion 6*a* of the planetary gear 6 in order to rotate the container body 1*a* in the clockwise direction in FIG. 14 would also be considered.

As shown in FIG. 14, a rectilinear line connecting the rotation center R of the container body 1*a* (rotation center R of the gear 5) and the rotation center P of the planetary gear 6 is a reference line i. On the other hand, a rectilinear line j connecting the rotation center P of the planetary gear 6 and the rotation center Q of the driving gear 12 is taken into consideration. Further, an angle θ formed between the reference line i and the rectilinear line j is taken into consideration.

Here, as shown in FIG. 14, the angle θ is measured as a rotating angle of the rectilinear line J about the rotation center P of the planetary gear 6 in the clockwise direction in FIG. 14 relative to the reference line i of 0°. The angle θ may preferably be made larger than 90° and smaller than 270°.

Particularly, it is preferable that with respect to the force (pulling force) E, generated by the engagement between the planetary gear 6 and the driving gear 12, for revolving the planetary gear 6 about the rotation center R as the revolving axis of the container body 1*a*, a directional component of the rotating force f in FIG. 14 of the force E is efficiently used. The directional component of the rotating force f is a component of force with respect to a tangential direction of the container body 1*a* at the engaging portion between the planetary gear 6 and the driving gear 12.

Accordingly, the angle θ formed between the reference line i and the rectilinear line j shown in FIG. 14 may preferably be set in a range of 120° to 240°. In order to further effectively use the directional component of the rotating force f in FIG. 14 of the force (pulling force) E for revolving the planetary gear 6 about, as the revolving axis, the rotation center R of the container body 1*a*, it is preferable that the angle θ formed by the reference line i and the rectilinear line j shown in FIG. 14 is set to a value close to 180°. In this embodiment, FIG. 14 shows an example in which the angle θ formed between the reference line i and the rectilinear line j is set to 180°.

In this embodiment, in view of the above-described points, arrangement positions of the gear 5, the planetary gear 6 and the driving gear 12 are set. In actuality, there are losses and the like of the gear 5, the planetary gear 6, the driving gear 12 and the gear train between the driving gear 12 and the motor 13 during drive transmission.

In this embodiment, description is made by omitting the losses of the respective gears during the drive transmission. Accordingly, in consideration of these losses of the gears during the drive transmission, various constitutions of the developer supply container 1 may only be required to be set so that the automatic rotation of the developer supply container 1 is properly performed.

In this embodiment, as the drive transmitting means for transmitting the rotational driving force of the driving gear 12 to the discharging member 4, gears such as the planetary gear 6 and the gear 5 were used. As a result, the drive transmission can be reliably carried out with a simple constitution.

When a supply (replenishment) test of the developer was conducted using the developer supply container 1 in this embodiment, there was no problem about the supply of the developer, so that image formation was able to be stably effected.

Incidentally, the developer receiving apparatus 10 is not limited to that having the constitution in this embodiment, but the developer receiving apparatus 10 may also be constituted so as to be mountable and demountable relative to the main assembly of the image forming apparatus 100. That is, the developer supply container 1 and the developer receiving apparatus 10 may also be constituted as an image forming unit capable of being mounted in and demounted from the main assembly of the image forming apparatus 100.

As an example of the image forming unit, it is possible to use a process cartridge including image forming process means such as the photosensitive drum as the image bearing member, the charger as the charging means and the cleaner as the cleaning means. As another example, it is also possible to use a developing cartridge including the developing device 201*a* in which the developing roller 201*b* or the like is provided.

In this embodiment, the braking torque generated by the torque generating mechanism constituted by the fixing member 9 and the ring member 14 provided on the gear 5 as shown in (a) of FIG. 7 and the locking member 7 shown in (a) to (c) of FIG. 9 is as follows. As shown in (b) of FIG. 9, the braking torque generated by the torque generating mechanism is canceled by releasing the locking member 7.

The braking torque generated by the torque generating mechanism may also be changed so as to be smaller than the rotational torque of the developer supply container 1 during the automatic rotation.

Materials, molding methods, shapes and the like of the respective members described above are not limited to those in this embodiment, but can also be appropriately selected within the range capable of providing a similar effect.

According to the constitution described above in the present invention, it is possible to not only remove the developer deposited on the outer peripheral surface of the developer supply container with reliability but also perform the automatic rotation of the developer supply container with reliability.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-228137 filed on Nov. 10, 2014, which is hereby incorporated by reference herein in its entirety.

What is claimed is:

1. A developer supplying container detachably mountable to a developer receiving apparatus that includes driving means and a wiping member for removing developer deposited on an outer peripheral surface of said developer supply container by sliding with said outer peripheral surface of said developer supply container, wherein said developer supply container is set by a setting operation with rotation thereof at least in a circumferential direction, said developer supply container comprising:

rotatable discharging means for discharging developer from said developer supply container to an outside of said developer supply container;

drive transmitting means for transmitting a driving force of the driving means to said discharging means;

suppressing means movable between an operating position where rotation of said drive transmitting means relative to said developer supply container is suppressed to rotate said developer supply container in the circumferential direction by the driving force received from the driving means and a non-operating position; and a recessed portion, provided on said outer peripheral surface of said developer supply container, for reducing a sliding load between said outer peripheral surface of said developer supply container and said wiping member when said developer supply container is rotated in the circumferential direction.

2. A developer supply container according to claim 1, wherein said recessed portion is provided on an upstream side of said developer supply container.

3. An image forming apparatus comprising:

a developer receiving apparatus to which a developer supply container according to claim 1 is detachably mountable; and a wiping member, provided in said developer receiving apparatus, for cleaning developer deposited on said outer peripheral surface of said developer supply container by sliding with said outer peripheral surface of said developer supply container when said developer supply container is mounted in and demounted from said developer receiving apparatus.

* * * * *